US012545536B2

(12) United States Patent
Akado

(10) Patent No.: US 12,545,536 B2
(45) Date of Patent: Feb. 10, 2026

(54) CONTROL APPARATUS CAPABLE OF REDUCING USER'S LABOR IN SETTING SHEET FEEDING UNIT, CONTROL METHOD FOR CONTROL APPARATUS, AND STORAGE MEDIUM

(71) Applicant: CANON KABUSHIKI KAISHA, Tokyo (JP)

(72) Inventor: Yukinobu Akado, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 18/778,651

(22) Filed: Jul. 19, 2024

(65) Prior Publication Data

US 2025/0026596 A1 Jan. 23, 2025

(30) Foreign Application Priority Data

Jul. 21, 2023 (JP) ..... 2023-119090

(51) Int. Cl.
*B65H 3/44* (2006.01)
*B65H 7/20* (2006.01)

(52) U.S. Cl.
CPC ..... *B65H 3/446* (2013.01); *B65H 7/20* (2013.01); *B65H 2511/13* (2013.01); *B65H 2515/10* (2013.01); *B65H 2557/64* (2013.01)

(58) Field of Classification Search
CPC . B65H 3/44; B65H 3/446; B65H 7/20; B65H 2511/13; B65H 2515/10; B65H 2557/64
See application file for complete search history.

(56) References Cited

U.S. PATENT DOCUMENTS 11,650,775 B2 5/2023 Kanamori
2009/0166949 A1* 7/2009 Unno ..... B65H 3/44 271/9.03
2013/0099440 A1* 4/2013 Hikichi ..... B65H 7/20 271/9.06
2014/0140749 A1* 5/2014 Harano ..... B41J 13/0009 400/582

FOREIGN PATENT DOCUMENTS

JP 2021-135897 A 9/2021

* cited by examiner

*Primary Examiner* — Prasad V Gokhale
(74) *Attorney, Agent, or Firm* — Venable LLP

(57) ABSTRACT

A control apparatus capable of reducing labor required for a user to set a sheet feeding unit is provided. The control apparatus that sets a sheet feeding unit to be used in a printing processing performed by an image forming apparatus including a plurality of sheet feeding units includes at least one processor, and a memory coupled to the processor storing instructions that, when executed by the processor, cause the processor to function as an obtaining unit that obtains information about sheets, which have been fed into the plurality of sheet feeding units, and a display control unit that displays a setting screen for allowing a user to select the sheet feeding unit to be used in the printing processing. Information about a virtual sheet feeding unit obtained by integrating two or more sheet feeding units, into which sheets satisfying a predetermined condition have been fed, into one is displayed.

22 Claims, 15 Drawing Sheets

| 500 ID | 501 PRINTER NAME | 502 SHEET FEEDING UNIT | 503 SHEET WIDTH | 504 SHEET TYPE | 505 SHEET CATEGORY | 506 ADDITIONAL SHEET INFORMATION |
|---|---|---|---|---|---|---|
| ID-A | PRINTER 1 | ROLL SHEET 1 | 24 INCH | PLAIN PAPER A | PLAIN PAPER | 56g, 0.2mm |
| ID-B | PRINTER 1 | ROLL SHEET 2 | 36 INCH | PLAIN PAPER A | PLAIN PAPER | 56g, 0.2mm |
| ID-C | PRINTER 1 | ROLL SHEET 3 | 36 INCH | COATED PAPER | COATED PAPER | 180g, 0.8mm |
| ID-D | PRINTER 1 | CUT SHEET | - | - | - | - |
| ID-E | PRINTER 1 | AUTOMATIC ROLL SHEET | 24 INCH, 36 INCH | PLAIN PAPER A | PLAIN PAPER | 56g, 0.2mm |
| ID-F | PRINTER 2 | ROLL SHEET 1 | 24 INCH | PLAIN PAPER A | PLAIN PAPER | 56g, 0.2mm |
| ID-G | PRINTER 2 | ROLL SHEET 2 | 36 INCH | COATED PAPER | COATED PAPER | 180g, 0.8mm |

FIG. 5

| 500 ID | 501 PRINTER NAME | 502 SHEET FEEDING UNIT | 503 SHEET WIDTH | 504 SHEET TYPE | 505 SHEET CATEGORY | 506 ADDITIONAL SHEET INFORMATION |
|---|---|---|---|---|---|---|
| ID-A | PRINTER 1 | ROLL SHEET 1 | 24 INCH | PLAIN PAPER A | PLAIN PAPER | 56g, 0.2mm |
| ID-B | PRINTER 1 | ROLL SHEET 2 | 36 INCH | PLAIN PAPER A | PLAIN PAPER | 56g, 0.2mm |
| ID-C | PRINTER 1 | ROLL SHEET 3 | 36 INCH | COATED PAPER | COATED PAPER | 180g, 0.8mm |
| ID-D | PRINTER 1 | CUT SHEET | - | - | - | - |
| ID-E | PRINTER 1 | AUTOMATIC ROLL SHEET | 24 INCH, 36 INCH | PLAIN PAPER A | PLAIN PAPER | 56g, 0.2mm |
| ID-F | PRINTER 2 | ROLL SHEET 1 | 24 INCH | PLAIN PAPER A | PLAIN PAPER | 56g, 0.2mm |
| ID-G | PRINTER 2 | ROLL SHEET 2 | 36 INCH | COATED PAPER | COATED PAPER | 180g, 0.8mm |

*FIG. 7*

| | | | | |
|---|---|---|---|---|
| A | AUTOMATIC ROLL SHEET | PLAIN PAPER | AUTOMATIC SELECTION | VIRTUAL SHEET FEEDING UNIT |
| 1 | ROLL SHEET 1 | PLAIN PAPER | 24 INCH | PHYSICAL SHEET FEEDING UNIT |
| 2 | ROLL SHEET 2 | PLAIN PAPER | 36 INCH | |
| 3 | ROLL SHEET 3 | COATED PAPER | 36 INCH | |
| | CUT SHEET | NO SHEET FEEDING | | |

*FIG. 8*

ONE EXAMPLE OF AUTOMATIC SELECTION CALCULATION

| PAGE SIZE | SELECTED SHEET WIDTH | PAGE SIZE < SHEET | MINIMUM MARGIN AREA |
|---|---|---|---|
| A2 (420mm × 594mm) → | 24 INCH (610mm) | Yes (24 INCH, 36 INCH) | 67.2cm$^2$ (24 INCH) |
| A0 (841mm × 1189mm) → | 36 INCH (914mm) | Yes (36 INCH) | – |

*FIG. 9*

| 900 ORDER OF PRINT | 901 JOB NAME | 902 NUMBER OF PAGES | 903 PAGE SIZE | 904 PRINT SETTING SHEET FEEDING UNIT | 905 OUTPUT DESTINATION SHEET FEEDING UNIT | 906 OUTPUT DESTINATION PRINTER | 907 JOB LIST NUMBER |
|---|---|---|---|---|---|---|---|
| 1 | JOB A | 3 | A2 | AUTOMATIC ROLL SHEET | ROLL SHEET 1 | Printer1 | 1 |
| 2 | JOB B | 2 | A0 | AUTOMATIC ROLL SHEET | ROLL SHEET 2 | Printer1 | 2 |
| 3 | JOB C | 5 | B1 | ROLL SHEET 2 | ROLL SHEET 2 | Printer1 | 2 |

*FIG. 14A*

1400

| 1401 ATTRIBUTE DETERMINATION ITEM | 1402 DETERMINATION PARAMETER | 1403 SUPPORTED ATTRIBUTE |
|---|---|---|
| FILE TYPE | PDF | DOCUMENT, DRAWING |
| FILE TYPE | HPGL/2 | DRAWING |
| FILE TYPE | TIFF | PHOTOGRAPH |

*FIG. 14B*

1404

| 1405 SHEET CATEGORY | 1406 SUPPORTED ATTRIBUTE |
|---|---|
| PLAIN PAPER | DOCUMENT, DRAWING |
| TRACING PAPER | DRAWING |
| GLOSSY PAPER | PHOTOGRAPH |

CONTROL APPARATUS CAPABLE OF REDUCING USER'S LABOR IN SETTING SHEET FEEDING UNIT, CONTROL METHOD FOR CONTROL APPARATUS, AND STORAGE MEDIUM

BACKGROUND OF THE INVENTION

Field of the Invention

The present invention relates to a control apparatus, a control method for the control apparatus, and a storage medium.

Description of the Related Art

With job submission software, it is possible to efficiently perform printing of a plurality of print jobs. In printing with the job submission software, when performing printing of a plurality of print documents, although an output size may differ for each print document, even in such a case, it is required to print each print document on a sheet with an appropriate size. In addition, from the standpoint of ease of user operation, etc., job submission software with a simple configuration that limits the number of print settings that can be set per printing to one is widely used.

As a technique for reducing the labor required for a user to perform print settings, a technique disclosed in Japanese Laid-Open Patent Publication (kokai) No. 2021-135897 has been proposed. In the technique disclosed in Japanese Laid-Open Patent Publication (kokai) No. 2021-135897, information about sheets fed into a plurality of sheet feeding units included in a printing apparatus is obtained, and in the case that it is possible to selectively determine one usage sheet feeding unit to be used for printing from among the plurality of sheet feeding units based on the obtained information about the sheets, printing is performed on the sheet supplied from the usage sheet feeding unit that has been determined.

However, the technique disclosed in Japanese Laid-Open Patent Publication (kokai) No. 2021-135897 may not be able to reduce the labor required for the user to set the sheet feeding unit. For example, in the case that the sheet fed into the sheet feeding unit is a sheet whose sheet length can be freely changed such as a roll sheet, since it is not possible to select one sheet feeding unit from among the plurality of sheet feeding units, the user needs to select the sheet feeding unit, into which the sheet suitable for a print document has been fed, from among the plurality of sheet feeding units.

SUMMARY OF THE INVENTION

The present invention provides a control apparatus capable of reducing labor required for a user to set a sheet feeding unit, a control method for the control apparatus, and a storage medium.

Accordingly, the present invention provides a control apparatus that sets a sheet feeding unit to be used in a printing processing performed by an image forming apparatus including a plurality of sheet feeding units, the control apparatus comprising at least one processor, and a memory coupled to the processor storing instructions that, when executed by the processor, cause the processor to function as an obtaining unit that obtains information about sheets, which have been fed into the plurality of sheet feeding units, respectively, and a display control unit that displays a setting screen for allowing a user to select the sheet feeding unit to be used in the printing processing from among the plurality of sheet feeding units based on the obtained information about the sheets. Information about a virtual sheet feeding unit, which is obtained by integrating two or more sheet feeding units, into which sheets satisfying a predetermined condition have been fed, among the plurality of sheet feeding units into one, is displayed on the setting screen. In a case that the information about the virtual sheet feeding unit has been selected by the user, one sheet feeding unit of the two or more sheet feeding units is set as the sheet feeding unit to be used in the printing processing.

Accordingly, the present invention provides a control apparatus that sets a sheet feeding unit to be used in a printing processing performed by an image forming apparatus including a plurality of sheet feeding units, the control apparatus comprising at least one processor, and a memory coupled to the processor storing instructions that, when executed by the processor, cause the processor to function as an obtaining unit that obtains information about sheets, which have been fed into the plurality of sheet feeding units, respectively, a first identifying unit that, based on the obtained information about the sheets and attribute information of a print document submitted, identifies sheet feeding units, into which sheets of sheet types suitable for the print document have been fed, from among the plurality of sheet feeding units, a second identifying unit that, based on the obtained information about the sheets and size information of the print document, identifies sheet feeding units, into which sheets with sheet widths suitable for the print document have been fed, from among the sheet feeding units identified by the first identifying unit, and a setting unit that sets the sheet feeding unit to be used in the printing processing from among the sheet feeding units identified by the second identifying unit.

According to the present invention, it is possible to reduce the labor required for the user to set the sheet feeding unit.

Further features of the present invention will become apparent from the following description of exemplary embodiments with reference to the attached drawings.

BRIEF DESCRIPTION OF THE DRAWINGS

FIG. 5 is a diagram that shows an example of sheet feeding unit information that has been stored in a sheet feeding unit information DB shown in FIG. 4B.

FIG. 7 is a diagram that shows an example of a sheet feeding unit list displayed in a sheet feeding method selecting section shown in FIG. 6.

FIG. 8 is a diagram for explaining how a sheet feeding unit used in a printing processing is set when "automatic roll sheet" has been selected in the sheet feeding method selecting section shown in FIG. 6.

FIG. 9 is a diagram that shows an example of information about print jobs that has been stored in a job information DB shown in FIG. 4B.

FIG. 14A is a diagram that shows an example of an attribute information DB managed by the PC shown in FIG. 1, and FIG. 14B is a diagram that shows an example of a sheet information DB managed by the PC shown in FIG. 1.

DESCRIPTION OF THE EMBODIMENTS

The present invention will now be described in detail below with reference to the accompanying drawings showing embodiments thereof.

Hereinafter, a preferred embodiment of the present invention will be described in detail with reference to the accompanying drawings. It should be noted that the following preferred embodiment does not limit the scope of the present invention as claimed, and not all of the combinations of features described in the following preferred embodiment are necessarily essential to the solving means of the present invention.

Figure 1:
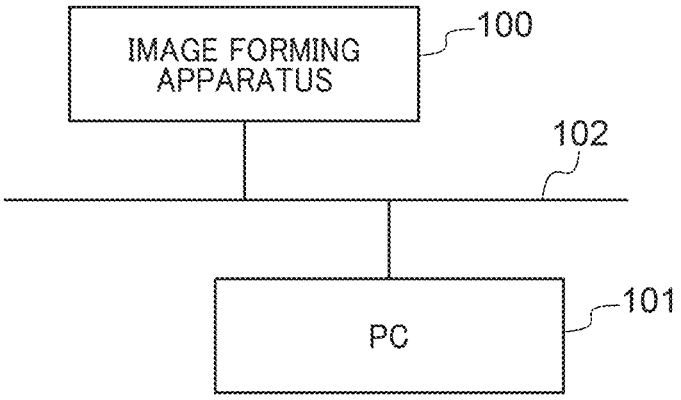
FIG. 1 is a configuration diagram that shows an example of a printing system including a control apparatus according to an embodiment of the present invention.

FIG. 1 is a configuration diagram that shows an example of a printing system including a control apparatus according to the preferred embodiment of the present invention. As shown in FIG. 1, the printing system includes an image forming apparatus 100 and a personal computer (hereinafter, referred to as "a PC") 101 that functions as the control apparatus according to the preferred embodiment of the present invention.

The image forming apparatus 100 is a printing apparatus having a printing function. It should be noted that the image forming apparatus 100 may be a large-sized printer, or may be a multi-function peripheral (an MFP) equipped with a scanner. In addition, the printing method of the image forming apparatus 100 may be either an electrophotographic method or an inkjet method, or may be another method. The image forming apparatus 100 is able to communicate with the PC 101 via a network 102.

The PC 101 obtains information relating to sheets that have been fed into the image forming apparatus 100 (hereinafter, referred to as "sheet feeding unit information"). In addition, the PC 101 transmits a print job to the image forming apparatus 100, and causes the image forming apparatus 100 to execute a printing processing based on the print job. It should be noted that in the present embodiment, a PC will be described as an example of the control apparatus, but the control apparatus is not limited to a PC and may be, for example, an information processing apparatus such as a smartphone, a tablet terminal, or a digital camera. In addition, in the present embodiment, a configuration will be described in which the printing system includes one image forming apparatus and one control apparatus, but the printing system is not limited to this configuration and may include two or more image forming apparatuses and two or more control apparatuses.

Figure 2:
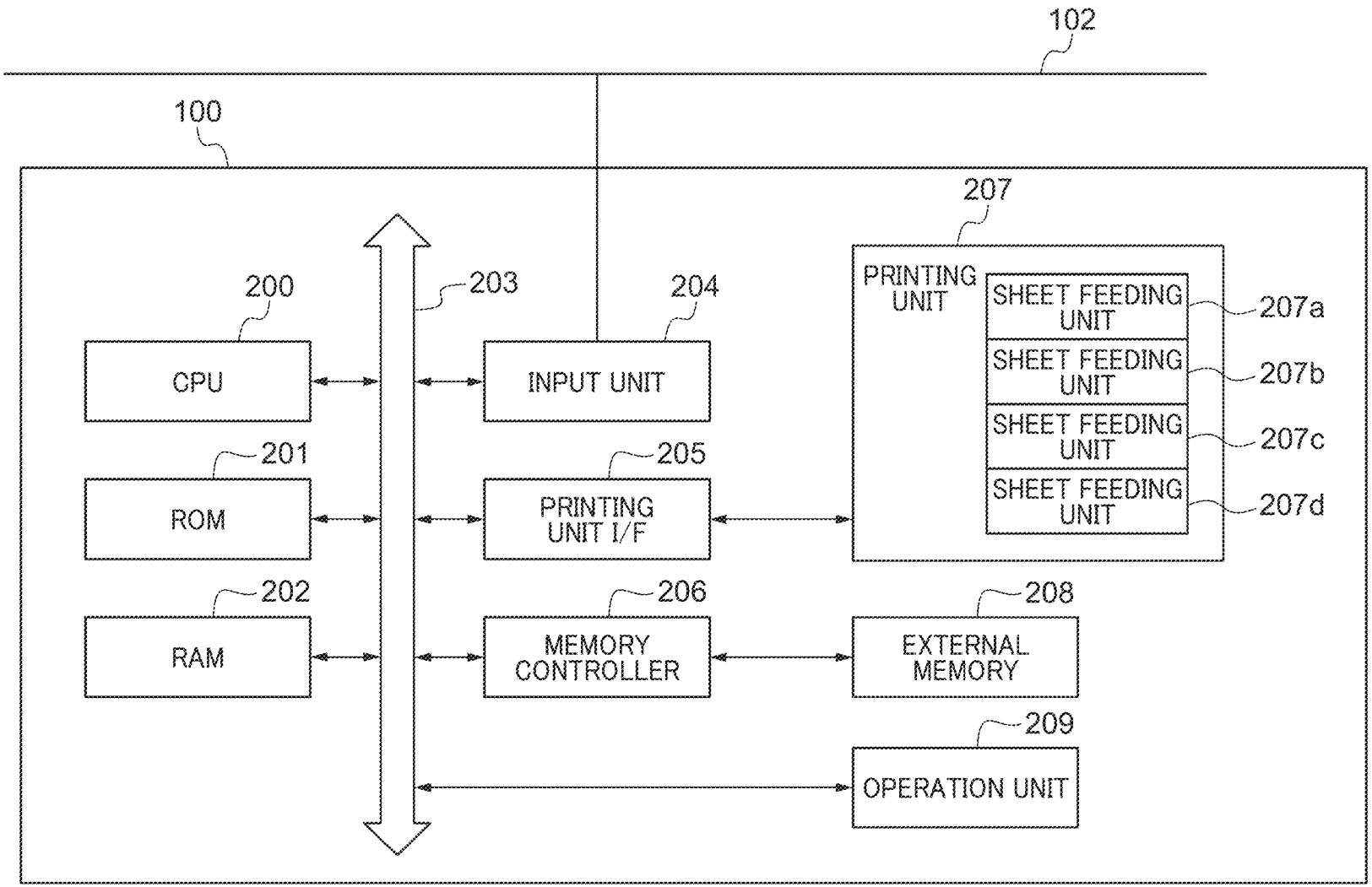
FIG. 2 is a block diagram that schematically shows a hardware configuration of an image forming apparatus shown in FIG. 1.

FIG. 2 is a block diagram that schematically shows a hardware configuration of the image forming apparatus 100 shown in FIG. 1. As shown in FIG. 2, the image forming apparatus 100 includes a central processing unit (a CPU) 200, a read only memory (a ROM) 201, a random access memory (a RAM) 202, an input unit 204, a printing unit interface (a printing unit I/F) 205, a memory controller 206, a printing unit 207, an external memory 208, and an operation unit 209. The CPU 200, the ROM 201, the RAM 202, the input unit 204, the printing unit I/F 205, the memory controller 206, and the operation unit 209 are connected to each other via a system bus 203.

The CPU 200 controls operations of the entire image forming apparatus 100 based on programs stored in the ROM 201 and the external memory 208. For example, the CPU 200 outputs image signals as output information to the printing unit 207 via the printing unit I/F 205. In addition, the CPU 200 communicates with the PC 101 via the input unit 204 and notifies the PC 101 of information about the image forming apparatus 100. The RAM 202 functions as a main memory, a working area, and the like for the CPU 200. The storage capacity of the RAM 202 is capable of being expanded by an optional RAM connected to an expansion port (not shown).

The printing unit 207 includes a plurality of sheet feeding units, and sheets with different characteristics such as a sheet type and a sheet size have been fed into the respective sheet feeding units. In the present embodiment, as an example, a configuration will be described in which the printing unit 207 includes four sheet feeding units, specifically, a sheet feeding unit 207*a*, a sheet feeding unit 207*b*, a sheet feeding unit 207*c*, and a sheet feeding unit 207*d*. Each of the sheet feeding unit 207*a*, the sheet feeding unit 207*b*, and the sheet feeding unit 207*c* is configured to be capable of feeding a roll sheet, and the sheet feeding unit 207*d* is configured to be capable of feeding a cut sheet. The printing unit 207 prints an image based on the image signals transmitted by the CPU 200 onto the sheet conveyed from the sheet feeding unit designated from among the sheet feeding unit 207*a*, the sheet feeding unit 207*b*, the sheet feeding unit 207*c*, and the sheet feeding unit 207*d*.

The external memory 208 is a storage device such as a hard disk drive (an HDD), and access thereto is controlled by the memory controller 206. The external memory 208 is connected as an option, and stores font data, emulation programs, form data, information about the sheets fed into the respective sheet feeding units, etc. The operation unit 209 includes a touch panel type display and hard keys. The display of the operation unit 209 displays the information about the image forming apparatus 100. In addition, the operation unit 209 accepts instructions inputted by a user.

Figure 3:
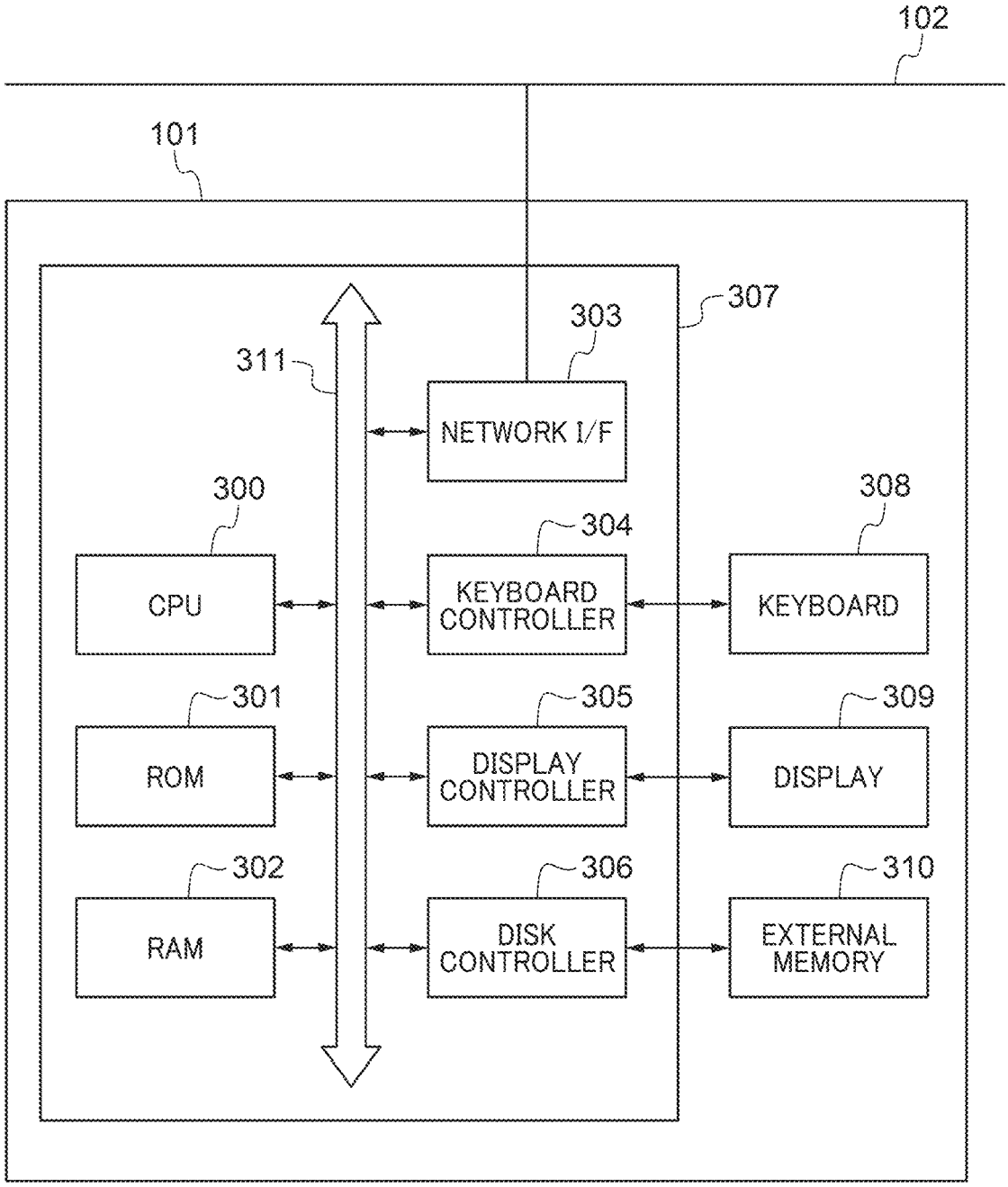
FIG. 3 is a block diagram that schematically shows a hardware configuration of a personal computer (a PC) shown in FIG. 1.

FIG. 3 is a block diagram that schematically shows a hardware configuration of the PC 101 shown in FIG. 1. As shown in FIG. 3, the PC 101 includes a control unit 307, a keyboard 308, a display 309, and an external memory 310. The control unit 307 includes a CPU 300, a ROM 301, a RAM 302, a network I/F 303, a keyboard controller 304, a display controller 305, and a disk controller 306. The CPU 300, the ROM 301, the RAM 302, the network I/F 303, the keyboard controller 304, the display controller 305, and the disk controller 306 are connected to each other via a main bus 311.

The CPU 300 controls the disk controller 306 to read out programs such as control programs, system programs, and application programs, which are stored in the external memory 310, into the RAM 302. It should be noted that the CPU 300 may read out the control programs and the like from the ROM 301. The CPU 300 executes the programs read into the RAM 302 to perform data processing, display control of the display 309, and the like. In addition, the CPU 300 communicates with the image forming apparatus 100 via the network I/F 303. It should be noted that the CPU 300 may be a dedicated circuit such as an application-specific integrated circuit (an ASIC).

The disk controller 306 controls access to the external memory 310 such as a CD-ROM, a DVD-ROM, a UDB, or an MO. The capacity of the RAM 302 is capable of being expanded by an optional RAM (not shown) or the like, and the RAM 302 is used mainly as a working area for the CPU 300.

The keyboard controller 304 controls key input from the keyboard 308 and/or a pointing device (not shown). The display controller 305 controls the display on the display 309.

Figure 4A:
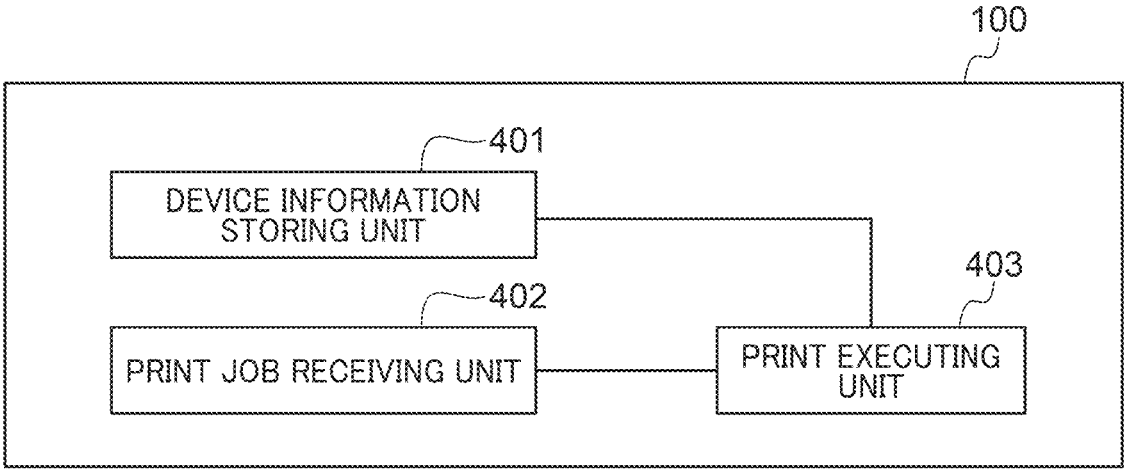
FIG. 4A is a block diagram that shows an example of functional blocks of the image forming apparatus shown in FIG. 1.
Figure 4B:
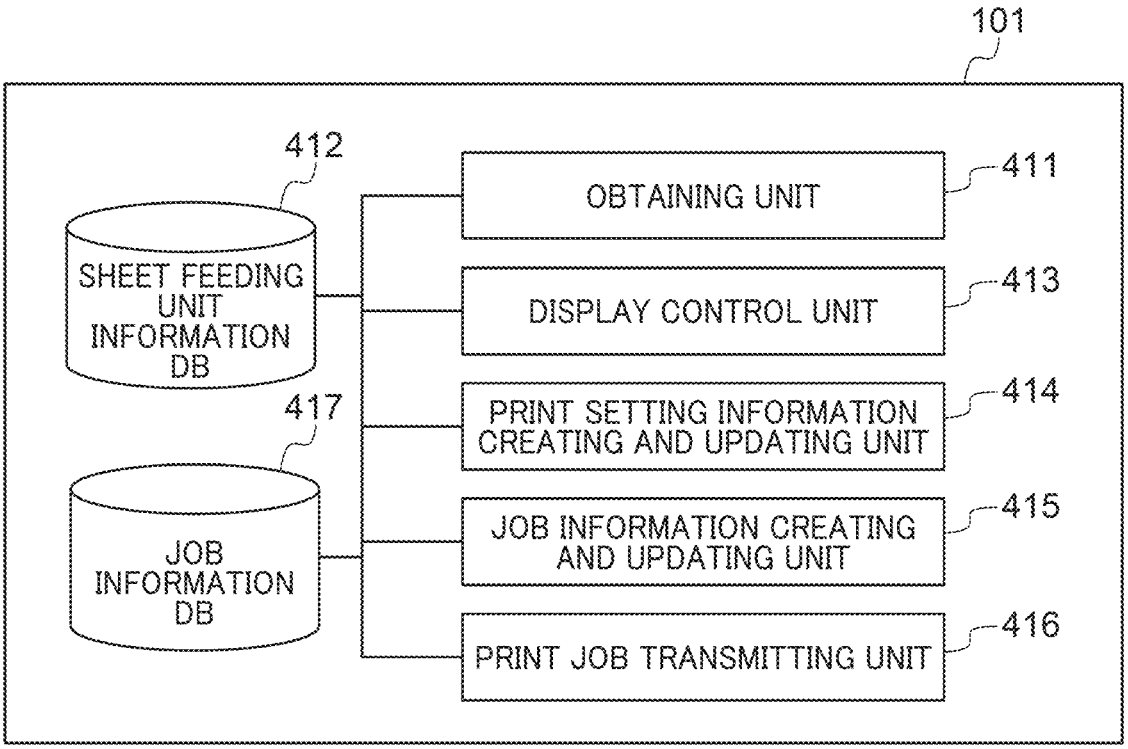
FIG. 4B is a block diagram that shows an example of functional blocks of the PC shown in FIG. 1.

FIG. 4A is a block diagram that shows an example of functional blocks of the image forming apparatus 100 shown in FIG. 1, and FIG. 4B is a block diagram that shows an example of functional blocks of the PC 101 shown in FIG. 1. FIG. 4A shows the example of the functional blocks of the image forming apparatus 100. As shown in FIG. 4A, the image forming apparatus 100 includes, as the functional blocks, a device information storing unit 401, a print job receiving unit 402, and a print executing unit 403. The processing of these functional blocks is realized by the CPU 200 of the image forming apparatus 100 executing a program stored in the ROM 201 or the like.

The device information storing unit 401 performs control to store status information of the image forming apparatus 100, which reflects a sheet feeding status and a device setting status, in the ROM 201 or the like, and manage the status information of the image forming apparatus 100. The status information of the image forming apparatus 100 includes, for example, the sheet feeding unit information of the sheet feeding unit 207*a*, the sheet feeding unit 207*b*, the sheet feeding unit 207*c*, and the sheet feeding unit 207*d*. The sheet feeding unit information includes, for example, information such as the sheet types and the sheet widths of the sheets fed into the sheet feeding unit 207*a*, the sheet feeding unit 207*b*, the sheet feeding unit 207*c*, and the sheet feeding unit 207*d*. The print job receiving unit 402 performs control to receive the print job transmitted from the PC 101. The print executing unit 403 confirms the consistency between the print job transmitted from the PC 101 and the information managed by the device information storing unit 401, and if there is no problem, executes the printing processing.

FIG. 4B shows the example of the functional blocks of the PC 101. As shown in FIG. 4B, the PC 101 includes, as the functional blocks, an obtaining unit 411, a sheet feeding unit information DB 412, a display control unit 413, a print setting information creating and updating unit 414, a job information creating and updating unit 415, a print job transmitting unit 416, and a job information DB 417. The processing of these functional blocks is realized by the CPU 300 executing a program stored in the ROM 301 or the like.

The obtaining unit 411 performs control to obtain the status information of the image forming apparatus 100 from a pre-registered image forming apparatus, for example, the image forming apparatus 100. It should be noted that in the present embodiment, it is assumed that a plurality of image forming apparatuses including the image forming apparatus 100 are registered in advance, and the obtaining unit 411 obtains status information from all the registered image forming apparatuses.

The sheet feeding unit information DB 412 stores the status information of the image forming apparatuses obtained by the obtaining unit 411, and information outputted from a printer driver (not shown) of the PC 101 and an operating system (an OS) (not shown) of the PC 101. It should be noted that as described above, the status information of the image forming apparatuses includes sheet feeding unit information. It should be noted that the obtaining unit 411, the sheet feeding unit information DB 412, the display control unit 413, the print setting information creating and updating unit 414, the job information creating and updating unit 415, the print job transmitting unit 416, and the job information DB 417 are part of functions of a print control application (not shown) that cooperates with the printer driver and causes the image forming apparatus 100 to execute the printing processing.

The display control unit 413 performs control to display, on the display 309, a print setting screen 600 shown in FIG. 6, which will be described below, for setting print setting information used in the printing processing. In addition, the display control unit 413 requests the job information creating and updating unit 415 to create a print job.

The print setting information creating and updating unit 414 compares the sheet feeding unit information of the image forming apparatus 100 that has been stored in the sheet feeding unit information DB 412 with setting values that have been set on the print setting screen 600, and requests the display control unit 413 to display warning information based on the result of the comparison.

The job information creating and updating unit 415 creates a print job based on the setting values that have been set on the print setting screen 600, and requests the print job transmitting unit 416 to transmit the created print job. The print job transmitting unit 416 transmits the print job created by the job information creating and updating unit 415 to the image forming apparatus 100.

The job information DB 417 is a database that stores information about the print job transmitted by the print job transmitting unit 416. The job information DB 417 retains the information about the print job, for example, for a period until the image forming apparatus 100 completes the execution of the print job, or for a period until the print job is canceled.

FIG. 5 is a diagram that shows an example of the sheet feeding unit information that has been stored in the sheet feeding unit information DB 412 shown in FIG. 4B. In the sheet feeding unit information DB 412, the sheet feeding unit information included in the status information obtained by the PC 101 from each image forming apparatus is managed by an ID 500. In the ID 500, an identifier for uniquely identifying the sheet feeding unit information is registered. In addition, in the sheet feeding unit information DB 412, information included in the sheet feeding unit information is registered as a printer name 501, a sheet feeding unit 502, a sheet width 503, a sheet type 504, a sheet category 505, and additional sheet information 506.

For example, information corresponding to ID-A is the sheet feeding unit information of the sheet feeding unit 207*a* of image forming apparatus 100. In this sheet feeding unit information (the information corresponding to ID-A), information indicating the image forming apparatus 100 is registered in the printer name 501, and information indicating the sheet feeding unit 207*a* and indicating being capable of feeding a roll sheet is registered in the sheet feeding unit 502. In addition, information indicating a sheet width of the roll sheet that has been fed into the sheet feeding unit 207*a* is registered in the sheet width 503, and information indicating a sheet type of the roll sheet that has been fed into the sheet feeding unit 207*a* is registered in the sheet type 504. Furthermore, information indicating a classification (a category) of the roll sheet that has been fed into the sheet feeding unit 207*a* is registered in the sheet category 505, and information including a weight and a thickness of the roll sheet that has been fed into the sheet feeding unit 207*a* is registered in the additional sheet information 506.

In addition, information corresponding to ID-B is the sheet feeding unit information of the sheet feeding unit 207*b* of image forming apparatus 100, information corresponding to ID-C is the sheet feeding unit information of the sheet feeding unit 207*c* of image forming apparatus 100, and information corresponding to ID-D is the sheet feeding unit information of the sheet feeding unit 207*d* of image forming apparatus 100. It should be noted that in the sheet feeding unit information DB 412, as the sheet feeding unit information of the sheet feeding unit into which no sheet has been fed, for example, information including only the printer name 501 and the sheet feeding unit 502 such as ID-D is registered. It should be noted that in the sheet feeding unit information DB 412, information other than the above-mentioned information may also be managed as the sheet feeding unit information. In addition, the printer name 501, the sheet feeding unit 502, the sheet width 503, the sheet type 504, the sheet category 505, and the additional sheet information 506 may be managed in separate databases. It should be noted that the information that has been stored in the sheet feeding unit information DB 412 may be configured so that the user is able to edit the information that has been stored in the sheet feeding unit information DB 412 on a screen displayed on the display 309 of the PC 101.

It should be noted that information about a virtual sheet feeding unit (for example, information on "ID-E") may also be registered in the sheet feeding unit information DB 412. It should be noted that the virtual sheet feeding unit will be described in detail below. In the information on "ID-E", "automatic roll sheet", which indicates that the sheet feeding unit is automatically selected, is registered in the sheet feeding unit 502, and a plurality of values, which become selection candidates for automatic roll sheet, are registered in the sheet width 503. It should be noted that in FIG. 5, although an example is shown in which the plurality of selection candidate values are registered only in the sheet width 503, a configuration, in which a single value is registered in the sheet width 503 and a plurality of selection candidate values are registered in the sheet type 504, may also be used.

Figure 6:
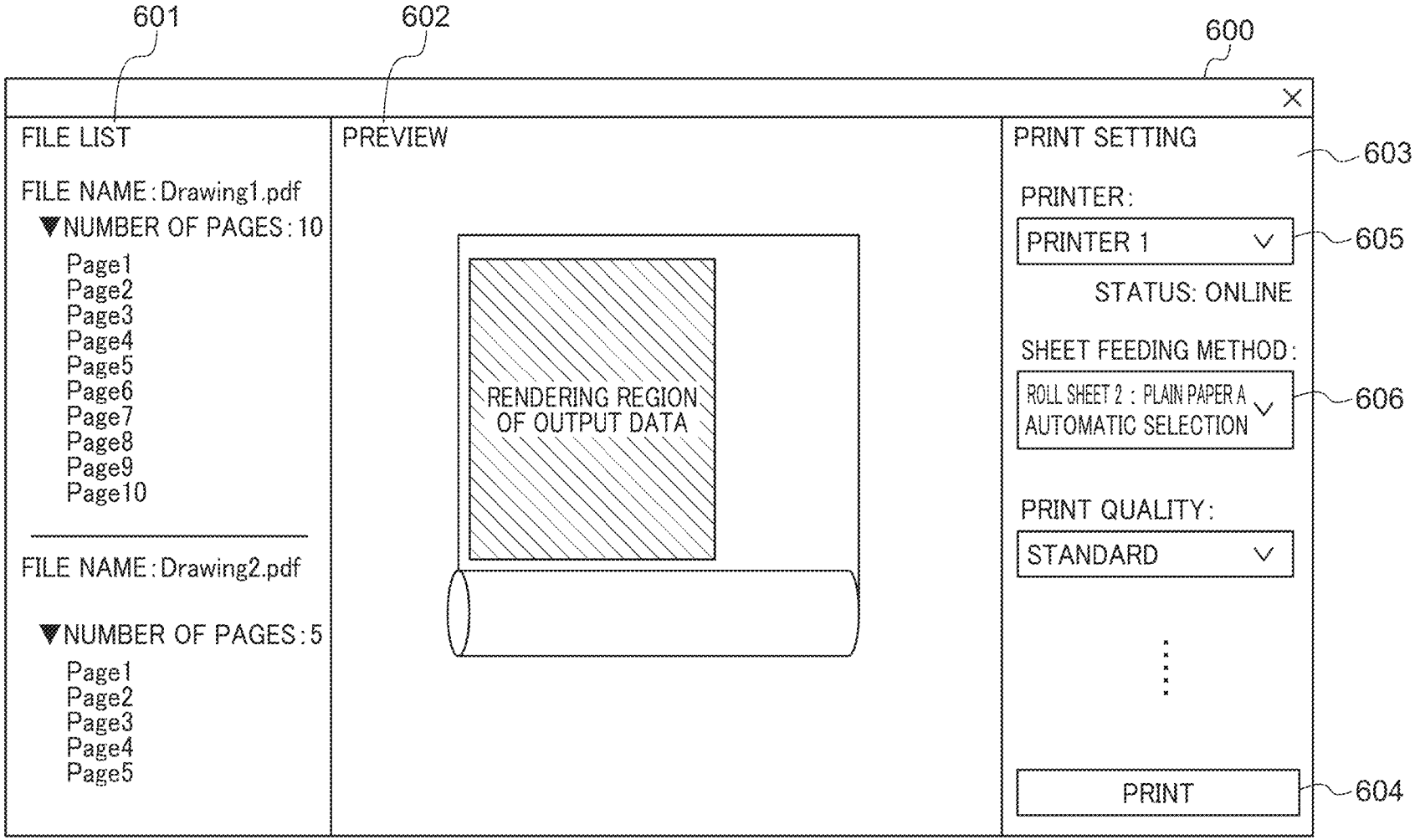
FIG. 6 is a diagram that shows an example of a print setting screen displayed on a display shown in FIG. 3.

FIG. 6 is a diagram that shows an example of the print setting screen 600 displayed on the display 309 shown in FIG. 3. The print setting screen 600 is a screen for issuing an instruction from the PC 101 to cause a pre-registered image forming apparatus to execute a printing processing, and is displayed on the display 309 when the print control application is started. On the print setting screen 600, it is possible to select a document to be printed and set the print setting information used in the printing processing.

The print setting screen 600 includes a file list display section 601, a preview display section 602, a print setting display section 603, and a print button 604. The file list display section 601 displays a list of information on a plurality of documents to be printed, page by page. The preview display section 602 displays a preview screen of the page selected in the file list display section 601. The print setting display section 603 includes a printer selecting section 605 for selecting an image forming apparatus to execute the printing processing, and a sheet feeding method selecting section 606 for selecting a sheet feeding unit to be used in the printing processing. The print button 604 is a button for issuing an instruction to create and transmit a print job. It should be noted that the configuration of the print setting screen 600 is an example, and the print setting screen 600 may include items other than the file list display section 601, the preview display section 602, and the print setting display section 603.

FIG. 7 is a diagram that shows an example of a sheet feeding unit list displayed in the sheet feeding method selecting section 606 shown in FIG. 6. This sheet feeding unit list is a sheet feeding unit list of the image forming apparatus 100, and is created based on the sheet feeding unit information of the image forming apparatus 100, which has been stored in the sheet feeding unit information DB 412, by a sheet feeding unit list creating processing shown in FIG. 10, which will be described below. This sheet feeding unit list includes information on the sheet feeding unit 502, information on the sheet type 504, and information on the sheet width 503, which are part of the sheet feeding unit information of the image forming apparatus 100 that has been stored in the sheet feeding unit information DB 412. It should be noted that information of "no sheet being fed" is included for the sheet feeding unit into which no sheet has been fed. "Roll sheet 1" corresponds to the sheet feeding unit 207*a* of the image forming apparatus 100, "roll sheet 2" corresponds to the sheet feeding unit 207*b* of the image forming apparatus 100, "roll sheet 3" corresponds to the sheet feeding unit 207*c* of the image forming apparatus 100, and "cut sheet" corresponds to the sheet feeding unit 207*d* of the image forming apparatus 100. It should be noted that in the following description, the sheet feeding unit 207*a*, the sheet feeding unit 207*b*, the sheet feeding unit 207*c*, and the sheet feeding unit 207*d* are referred to as "physical sheet feeding units". "Automatic roll sheet" corresponds to a virtual sheet feeding unit that integrates a plurality of physical sheet feeding units from among the sheet feeding unit 207*a*, the sheet feeding unit 207*b*, the sheet feeding unit 207*c*, and the sheet feeding unit 207*d*, into which sheets with the same sheet type but different sheet widths have been fed, into one. For example, a virtual sheet feeding unit of the image forming apparatus 100 including the sheet feeding unit 207*a* and the sheet feeding unit 207*b*, into which sheets with the same sheet type 504 (plain paper A) but different sheet widths 503 (24 inches and 36 inches) have been fed, is a virtual sheet feeding unit that integrates the sheet feeding unit 207*a* and the sheet feeding unit 207*b* into one. In the case that "automatic roll sheet" has been selected, as the sheet feeding unit to be used in the printing processing, the physical sheet feeding unit, into which the sheet, on which an optimal printing result can be obtained, has been fed, from among the plurality of physical sheet feeding units is set.

FIG. 8 is a diagram for explaining how the sheet feeding unit to be used in the printing processing is set when "automatic roll sheet" has been selected in the sheet feeding method selecting section 606 shown in FIG. 6. It should be noted that the procedure of the processing when "automatic roll sheet" has been selected in the sheet feeding method selecting section 606 shown in FIG. 6 will be described below with reference to FIG. 10.

In the case that "automatic roll sheet" has been selected in the sheet feeding method selecting section 606, the PC 101 obtains a page size of a print document that has been submitted to the file list display section 601. The PC 101 determines whether or not data of this page size is fit in the sheets being fed into all the physical sheet feeding units corresponding to the virtual sheet feeding unit, that is, determines whether or not no image defect occurs in the sheets being fed into all the physical sheet feeding units corresponding to the virtual sheet feeding unit, and retains the result of the determination. It should be noted that in this determination, in the case that the sheet, in which at least one of data, in which the print document has not been rotated, and data, in which the print document has been rotated 90 degrees, is fit, has been fed into any one of the physical sheet feeding units corresponding to the virtual sheet feeding unit, it is determined that the sheet, in which the data of the page size is fit, has been fed into any one of the physical sheet feeding units corresponding to the virtual sheet feeding unit. In the case that there are a plurality of the physical sheet feeding units, into which the sheet, in which the data of the page size is fit, has been fed, from among the plurality of the physical sheet feeding units, the sheet feeding unit, into which the sheet with the minimum margin area (the smallest margin area) has been fed, is set to the sheet feeding unit to be used in the printing processing. It should be noted that in the present embodiment, the calculation of the margin area is performed for both the case where the print document has not been rotated and the case where the print document has been rotated 90 degrees. From among these calculated margin areas, the sheet feeding unit, into which the sheet with the minimum margin area (the smallest margin area) has been fed, is set to the sheet feeding unit to be used in the printing processing.

As an example, in the case that the page size of the print document is A2 (width: 420 [mm], height: 594 [mm]), no image defect occurs in both the 24-inch sheet (the roll sheet) fed into the sheet feeding unit 207*a* and the 36-inch sheet (the roll sheet) fed into the sheet feeding unit 207*b*. For this reason, the PC 101 performs the calculation of the margin area for each of the sheet feeding unit 207*a* and the sheet feeding unit 207*b*. When printing data of A2 page size on the roll sheet, rotating the data of A2 page size by 90 degrees will result in a smaller margin. When the data of A2 page size is rotated 90 degrees, the margin of the sheet in the sheet feeding unit 207*a* becomes 420 [mm]×(610 [mm]−594 [mm])=6720 [$mm^2$]. In addition, when the data of A2 page size is rotated 90 degrees, the margin of the sheet in the sheet feeding unit 207*b* becomes 420 [mm]×(914 [mm]−594 [mm])=134400 [$mm^2$]. Based on these calculation results, the PC 101 sets the sheet feeding unit 207*a*, into which the sheet with the minimum margin (the smallest margin) has been fed, to the sheet feeding unit to be used in the printing processing.

In addition, as another example, in the case that the page size of the print document is A0 (width: 841 [mm], height: 1189 [mm]), as described above, the PC 101 performs the determination of the presence or absence of the image defect. Since the physical sheet feeding unit, into which the sheet, in which the data of A0 page size is fit, has been fed, is only the sheet feeding unit 207*b*, into which the 36-inch sheet (the roll sheet) has been fed, the PC 101 does not perform the calculation of the margin area, and sets the sheet feeding unit 207*b* to the sheet feeding unit to be used in the printing processing.

FIG. 9 is a diagram that shows an example of information about print jobs that has been stored in the job information DB 417 shown in FIG. 4B. In the job information DB 417, the information about the print job has been registered as a print order (an order of print) 900, a job name 901, the number of pages 902, a page size 903, a print setting sheet feeding unit 904, an output destination sheet feeding unit 905, an output destination printer 906, and a job list number 907. It should be noted that the items shown in FIG. 9 are merely one example, and only information on some of these items may be retained, or information on other items other than these items may be further retained. In addition, each item may be managed in a separate file.

In the job information DB 417, for example, when a print document is submitted to the file list display section 601, information on the number of pages of the print document and information on the page size of the print document are registered in the number of pages 902 and the page size 903. In addition, when an image forming apparatus is selected in the printer selecting section 605, information indicating this image forming apparatus is registered in the output destination printer 906. Furthermore, when a sheet feeding unit is selected in the sheet feeding method selecting section 606, information indicating this sheet feeding unit is registered in the print setting sheet feeding unit 904. These pieces of information are updated every time the user changes the settings (the setting contents) on the print setting screen 600. In addition, in the case that "automatic roll sheet" has been selected in the sheet feeding method selecting section 606, by a sheet feeding unit selecting processing shown in FIG. 11, which will be described below, information indicating the physical sheet feeding unit set as the sheet feeding unit to be used in the printing processing is registered in the output destination sheet feeding unit 905.

Figure 10:
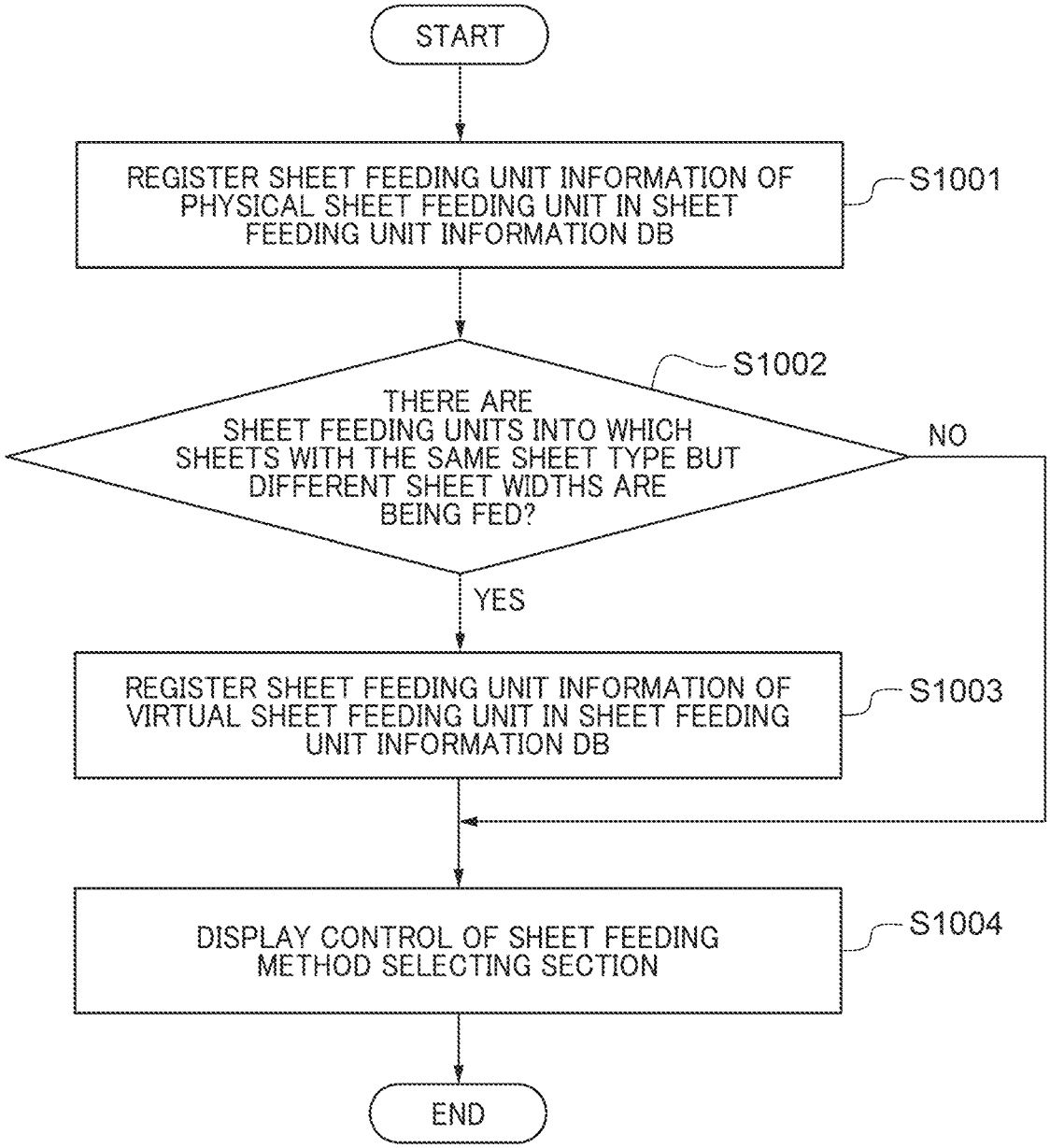
FIG. 10 is a flowchart that shows a procedure of a sheet feeding unit list creating processing executed by the PC shown in FIG. 1.

Next, the creation of the sheet feeding unit list displayed on the sheet feeding method selecting section 606 will be described. FIG. 10 is a flowchart that shows a procedure of the sheet feeding unit list creating processing executed by the PC 101 shown in FIG. 1. The sheet feeding unit list creating processing is realized by the CPU 300 executing a program stored in the ROM 301 or the like. In the present embodiment, for example, when the print control application is started and the print setting screen 600 is displayed on the display 309, the CPU 300 obtains status information from a plurality of image forming apparatuses that have been registered in advance, and starts the sheet feeding unit list creating processing. It should be noted that in FIG. 10, as an example, a processing of creating the sheet feeding unit list of the image forming apparatus 100 from among the plurality of image forming apparatuses that have been registered will be described. It should be noted that the sheet feeding unit list creating processing may be started at a timing when an image forming apparatus has been selected in the printer selecting section 605, a timing when having been changed to another image forming apparatus in the printer selecting section 605, or a timing when a change in the sheet feeding unit information of the image forming apparatus set in the printer selecting section 605 has been detected.

As shown in FIG. 10, first, the CPU 300 registers the sheet feeding unit information of the physical sheet feeding unit in the sheet feeding unit information DB 412 based on the status information obtained from the image forming apparatus 100 (S1001). It should be noted that as described above, the physical sheet feeding units of the image forming apparatus 100 are the sheet feeding unit 207*a*, the sheet feeding unit 207*b*, the sheet feeding unit 207*c*, and the sheet feeding unit 207*d*, and the sheet feeding unit information of these physical sheet feeding units is the information ID-A, ID-B, ID-C, and ID-D that are shown in FIG. 5.

Next, the CPU 300 determines whether or not there are sheet feeding units in the image forming apparatus 100 into which sheets with the same sheet type 504 but different sheet widths 503 have been fed (S1002). For example, in the image forming apparatus 100, there are the sheet feeding unit 207*a* and the sheet feeding unit 207*b*, into which the sheets with the same sheet type 504 (plain paper A) but different sheet widths 503 (24 inches and 36 inches) have been fed. In such a case, it is determined in S1002 that there are sheet feeding units in the image forming apparatus 100 into which the sheets with the same sheet type 504 but different sheet widths 503 have been fed, and the sheet feeding unit list creating processing proceeds to S1003.

In S1003, the CPU 300 registers, in the sheet feeding unit information DB 412, sheet feeding unit information of a virtual sheet feeding unit that is obtained by integrating the sheet feeding unit 207*a* and the sheet feeding unit 207*b*, into which the sheets with the same sheet type 504 but different sheet widths 503 have been fed, into one. Specifically, the CPU 300 registers the information ID-E in the sheet feeding unit information DB 412 as the sheet feeding unit information of the virtual sheet feeding unit. In the information ID-E, for example, "automatic roll sheet" is registered in the sheet feeding unit 502. In addition, the sheet types of the sheets that have been fed into the sheet feeding unit 207*a* and the sheet feeding unit 207*b*, respectively, specifically, "plain paper A", is registered in the sheet type 504, and the sheet widths of the sheets that have been fed into the sheet feeding unit 207*a* and the sheet feeding unit 207*b*, respectively, specifically, "24 inches, 36 inches" is registered in the sheet width 503.

Next, the CPU 300 creates the sheet feeding unit list shown in FIG. 7 based on the sheet feeding unit information DB 412. This sheet feeding unit list includes the information about the physical sheet feeding units and the information about the virtual sheet feeding unit in the image forming apparatus 100. Next, the CPU 300 performs display control of the sheet feeding method selecting section 606 based on this sheet feeding unit list (S1004), and ends the sheet feeding unit list creating processing. As a result, when the user has selected the image forming apparatus 100 in the printer selecting section 605, the user is able to select one from among the physical sheet feeding units and the virtual sheet feeding unit, which are included in the sheet feeding unit list, in the sheet feeding method selecting section 606. For example, in the case that "automatic roll sheet" has been selected in the sheet feeding method selecting section 606, the PC 101 executes the sheet feeding unit selecting processing shown in FIG. 11, which will be described below.

In the case of being determined in S1002 that there are no sheet feeding units in the image forming apparatus 100 into which the sheets with the same sheet type 504 but different sheet widths 503 have been fed, the sheet feeding unit list creating processing proceeds to S1004, and thereafter the sheet feeding unit list creating processing ends. In this case, a sheet feeding unit list that does not include the virtual sheet feeding unit is created, and the user is able to select one from among the physical sheet feeding units, which are included in the sheet feeding unit list not including the virtual sheet feeding unit, in the sheet feeding method selecting section 606.

Figure 11:
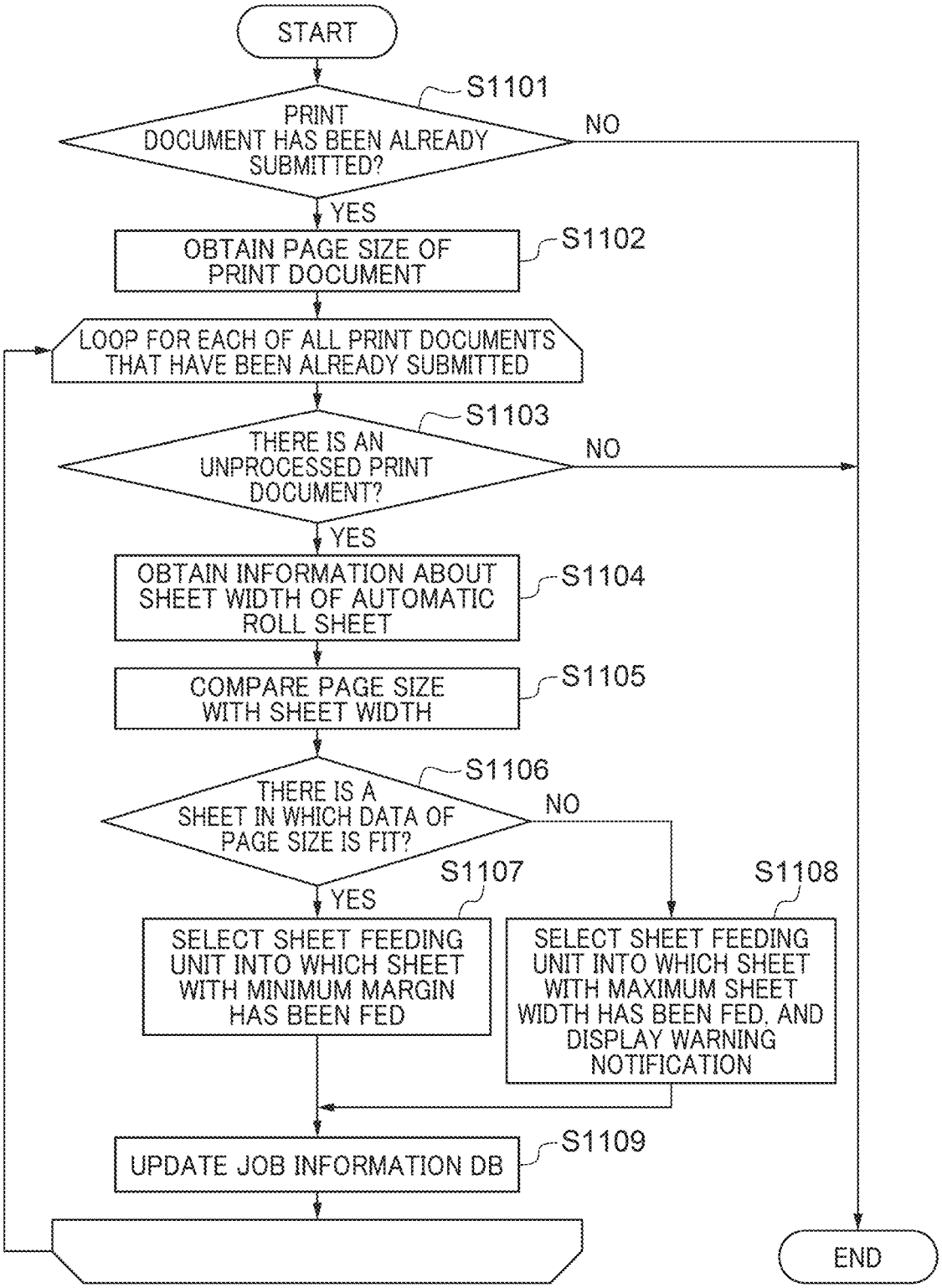
FIG. 11 is a flowchart that shows a procedure of a sheet feeding unit selecting processing executed by the PC shown in FIG. 1.

FIG. 11 is a flowchart that shows a procedure of the sheet feeding unit selecting processing executed by the PC 101 shown in FIG. 1. The sheet feeding unit selecting processing is realized by the CPU 300 executing a program stored in the ROM 301 or the like. The sheet feeding unit selecting processing is executed at a timing when "automatic roll sheet" has been selected in the sheet feeding method selecting section 606.

As shown in FIG. 11, first, the CPU 300 determines whether or not the print document has been already submitted to the file list display section 601 (S1101). In the case of being determined in S1101 that the print document has not been submitted to the file list display section 601, the sheet feeding unit selecting processing ends. On the other hand, in the case of being determined in S1101 that the print document has been already submitted to the file list display section 601, the sheet feeding unit selecting processing proceeds to S1102.

In S1102, the CPU 300 obtains the page size of the already-submitted print document. Next, the CPU 300 executes processes of S1103 to S1109 for all the print documents that have been submitted to the file list display section 601.

In S1103, the CPU 300 determines whether or not there are unprocessed print documents remaining among the print documents that have been submitted to the file list display section 601. In the case of being determined in S1103 that there are no unprocessed print documents remaining among the print documents that have been submitted to the file list display section 601, the sheet feeding unit selecting processing ends. On the other hand, in the case of being determined in S1103 that there are unprocessed print documents remaining among the print documents that have been submitted to the file list display section 601, the CPU 300 identifies one print document from among the unprocessed print documents. Next, the sheet feeding unit selecting processing proceeds to S1104.

In S1104, the CPU 300 obtains, from the sheet feeding unit information DB 412, information about the sheet widths corresponding to "automatic roll sheet" that has been selected by the user. Specifically, the CPU 300 obtains "24 inches, 36 inches" from the information ID-E in the sheet feeding unit information DB 412.

Next, in S1105, the CPU 300 compares the page size of the identified print document with the sheet widths indicated by the information obtained in S1104. Next, in S1106, the CPU 300 determines whether or not the sheets with the sheet widths (24 inches, 36 inches) indicated by the information obtained in S1104 include sheet(s), in which data of the page size of the identified print document is fit. It should be noted that in S1106, as described above, the determination is performed for both the case where the identified print document has not been rotated and the case where the identified print document has been rotated 90 degrees.

In the case of being determined in S1106 that the sheets with the sheet widths indicated by the information obtained in S1104 include sheet(s), in which the data of the page size of the identified print document is fit, the sheet feeding unit selecting processing proceeds to S1107. In S1107, the CPU 300 selects, as the sheet feeding unit to be used in the printing processing, the physical sheet feeding unit, into which the sheet with the minimum margin (the smallest margin) has been fed, from among the physical sheet feeding units, into which the sheet(s), in which the data of the page size of the identified print document is fit, have been fed. It should be noted that in the case that there is only one physical sheet feeding unit, into which the sheet, in which the data of the page size of the identified print document is fit, has been fed, this physical sheet feeding unit is selected as the sheet feeding unit to be used in the printing processing. Next, the sheet feeding unit selecting processing proceeds to S1109, which will be described below.

On the other hand, in the case of being determined in S1106 that the sheets with the sheet widths indicated by the information obtained in S1104 do not include sheet(s), in which the data of the page size of the identified print document is fit, the sheet feeding unit selecting processing proceeds to S1108. In S1108, the CPU 300 selects, as the sheet feeding unit to be used in the printing processing, the physical sheet feeding unit, into which the sheet that will result in the smallest image defect amount has been fed, specifically, the sheet feeding unit 207*b* that is the physical sheet feeding unit, into which the sheet with the maximum sheet width has been fed, among the physical sheet feeding units (the sheet feeding unit 207*a* and the sheet feeding unit 207*b*) corresponding to the virtual sheet feeding unit. In addition, in S1108, the CPU 300 displays a warning notification, which indicates that the image defect will occur, on the print setting screen 600. The warning notification includes a message prompting to change the page size of the print document, and/or a message prompting to replace the sheet fed into the sheet feeding unit of the image forming apparatus 100.

Next, the CPU 300 updates the job information DB 417 (S1109). Specifically, the CPU 300 records (sets) the information indicating the physical sheet feeding unit, which has been selected in S1107 or S1108, in the output destination sheet feeding unit 905. Thereafter, the sheet feeding unit selecting processing ends.

According to the embodiment described above, the print setting screen 600 displays the information about the virtual sheet feeding unit that is obtained by integrating two or more physical sheet feeding units that satisfy a predetermined condition among the sheet feeding unit 207*a*, the sheet feeding unit 207*b*, the sheet feeding unit 207*c*, and the sheet feeding unit 207*d* into one. In the case that the information about the virtual sheet feeding unit has been selected by the user, one of the two or more physical sheet feeding units is set to the sheet feeding unit to be used in the printing processing. In other words, the user does not need to select a sheet feeding unit, into which the sheet suitable for the print document has been fed, from among the plurality of the sheet feeding unit 207*a*, the sheet feeding unit 207*b*, the sheet feeding unit 207*c*, and the sheet feeding unit 207*d*. As a result, it is possible to reduce the labor required for the user to set the sheet feeding unit.

In addition, in the embodiment described above, of the two or more physical sheet feeding units corresponding to the virtual sheet feeding unit, the sheet feeding unit, into which the sheet that does not cause the image defect and has the smallest margin area has been fed, is set to the sheet feeding unit to be used in the printing processing. As a result, the user is able to set the sheet feeding unit, into which the sheet that does not cause the image defect and has the smallest margin area has been fed, to the sheet feeding unit to be used in the printing processing without selecting a sheet feeding unit, into which the sheet suitable for the print document has been fed, from among the plurality of the sheet feeding unit 207*a*, the sheet feeding unit 207*b*, the sheet feeding unit 207*c*, and the sheet feeding unit 207*d*.

In addition, in the embodiment described above, based on the data obtained by performing a rotating processing on the submitted print document, the determination of the presence or absence of the image defect and the calculation of the margin area are performed. As a result, it is possible to perform with high accuracy a determination of whether or not it is the sheet suitable for the print document, required for setting a sheet feeding unit, into which the sheet suitable for the print document has been fed.

In addition, in the embodiment described above, the virtual sheet feeding unit is obtained by integrating two or more physical sheet feeding units, into which the sheets with different sheet widths but the same predetermined characteristic other than the sheet width have been fed, among the sheet feeding unit 207*a*, the sheet feeding unit 207*b*, the sheet feeding unit 207*c*, and the sheet feeding unit 207*d*. As a result, the user is able to set the sheet feeding unit, into which the sheet with the sheet width suitable for the print document has been fed, to the sheet feeding unit to be used in the printing processing without selecting a sheet feeding unit, into which the sheet suitable for the print document has been fed, from among the plurality of the sheet feeding unit 207*a*, the sheet feeding unit 207*b*, the sheet feeding unit 207*c*, and the sheet feeding unit 207*d*.

In addition, in the embodiment described above, since the predetermined characteristic is the sheet type, the user is able to set the sheet feeding unit, into which the sheet suitable for the print document has been fed, to the sheet feeding unit to be used in the printing processing simply by selecting the information about the virtual sheet feeding unit that corresponds to a desired sheet type.

It should be noted that in the present embodiment, the predetermined characteristic is not limited to the sheet type, but may be, for example, a weight of the sheet or a thickness of the sheet. As a result, the user is able to set the sheet feeding unit, into which the sheet suitable for the print document has been fed, to the sheet feeding unit to be used in the printing processing simply by selecting the information about the virtual sheet feeding unit that corresponds to a desired weight of the sheet or a desired thickness of the sheet.

In addition, in the present embodiment, the virtual sheet feeding unit may be a virtual sheet feeding unit that is obtained by integrating a plurality of physical sheet feeding units, into which the sheets having the same sheet width but different in the above predetermined characteristic have been fed, among the sheet feeding unit 207*a*, the sheet feeding unit 207*b*, the sheet feeding unit 207*c*, and the sheet feeding unit 207*d*. The processing of creating a sheet feeding unit list including such a virtual sheet feeding unit will be described with reference to FIG. 12, and the processing when such a virtual sheet feeding unit has been selected will be described with reference to FIG. 13, FIG. 14A and FIG. 14B. It should be noted that hereinafter, the sheet type will be described as an example of the predetermined characteristic.

Figure 12:
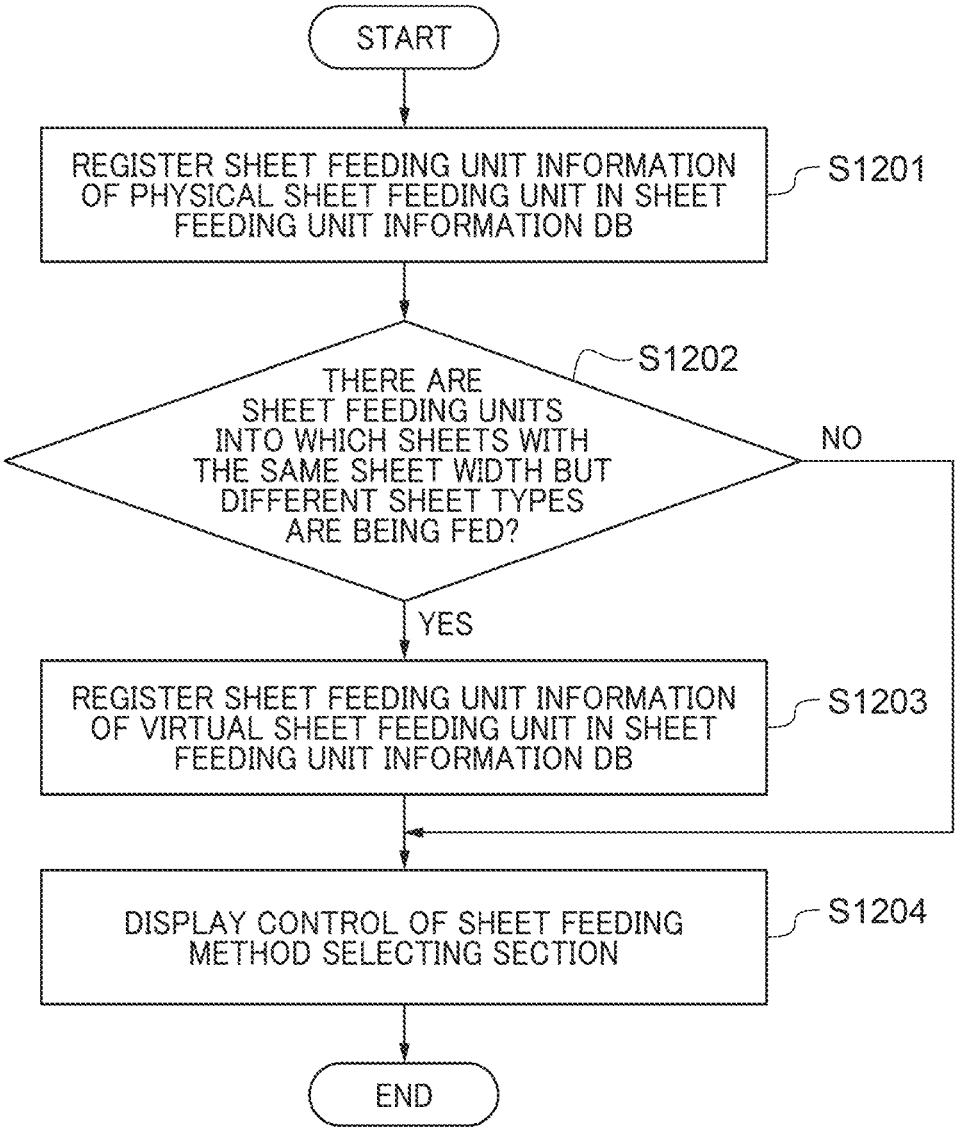
FIG. 12 is a flowchart that shows another procedure of the sheet feeding unit list creating processing executed by the PC shown in FIG. 1.

FIG. 12 is a flowchart that shows another procedure of the sheet feeding unit list creating processing executed by the PC 101 shown in FIG. 1. It should be noted that the sheet feeding unit list creating processing shown in FIG. 12 is similar to the sheet feeding unit list creating processing shown in FIG. 10 described above, and hereinafter, in particular, the contents that are different from the sheet feeding unit list creating processing shown in FIG. 10 described above will be described. Similar to the sheet feeding unit list creating processing shown in FIG. 10 described above, the sheet feeding unit list creating processing shown in FIG. 12 is also realized by the CPU 300 executing a program stored in the ROM 301 or the like. It should be noted that the sheet feeding unit list creating processing shown in FIG. 12 is started at the same timing as the sheet feeding unit list creating processing shown in FIG. 10 described above.

As shown in FIG. 12, the CPU 300 performs S1201, which is the same process as S1001 described above. Next, the CPU 300 determines whether or not there are sheet feeding units in the image forming apparatus 100 into which sheets with the same sheet width 503 but different sheet types 504 have been fed (S1202). For example, in the case that 24-inch plain paper A is fed into the sheet feeding unit 207*a*, 24-inch tracing paper is fed into the sheet feeding unit 207*b*, and 24-inch glossy paper is fed into the sheet feeding unit 207*c*, it is determined in S1202 that there are sheet feeding units in the image forming apparatus 100 into which sheets with the same sheet width 503 but different sheet types 504 have been fed, and the sheet feeding unit list creating processing proceeds to S1203.

In S1203, the CPU 300 registers, in the sheet feeding unit information DB 412, sheet feeding unit information of a virtual sheet feeding unit that is obtained by integrating the sheet feeding unit 207*a*, the sheet feeding unit 207*b*, and the sheet feeding unit 207*c*, into which the sheets with the same sheet width 503 but different sheet types 504 have been fed, into one. As the sheet feeding unit information of the virtual sheet feeding unit, for example, in the sheet width 503 of the sheet feeding unit information DB 412, the sheet widths of the sheets that have been fed into the sheet feeding unit 207*a*, the sheet feeding unit 207*b*, and the sheet feeding unit 207*c*, respectively, specifically, "24 inches" is registered. In addition, in the sheet type 504, the sheet types of the sheets that have been fed into the sheet feeding unit 207*a*, the sheet feeding unit 207*b*, and the sheet feeding unit 207*c*, respectively, specifically, "plain paper A, tracing paper, glossy paper" is registered. In addition, in the sheet category 505, the sheet categories of the sheets that have been fed into the sheet feeding unit 207*a*, the sheet feeding unit 207*b*, and the sheet feeding unit 207*c*, respectively, specifically, "plain paper, tracing paper, glossy paper" is registered.

Next, the CPU 300 creates a sheet feeding unit list based on the sheet feeding unit information DB 412. This sheet feeding unit list includes the information about the physical sheet feeding units and the information about the virtual sheet feeding unit in the image forming apparatus 100. Next, the CPU 300 performs display control of the sheet feeding method selecting section 606 based on this sheet feeding unit list (S1204), and ends the sheet feeding unit list creating processing.

In the case of being determined in S1202 that there are no sheet feeding units in the image forming apparatus 100 into which the sheets with the same sheet width 503 but different sheet types 504 have been fed, the sheet feeding unit list creating processing proceeds to S1204, and thereafter the sheet feeding unit list creating processing ends.

Figure 13:
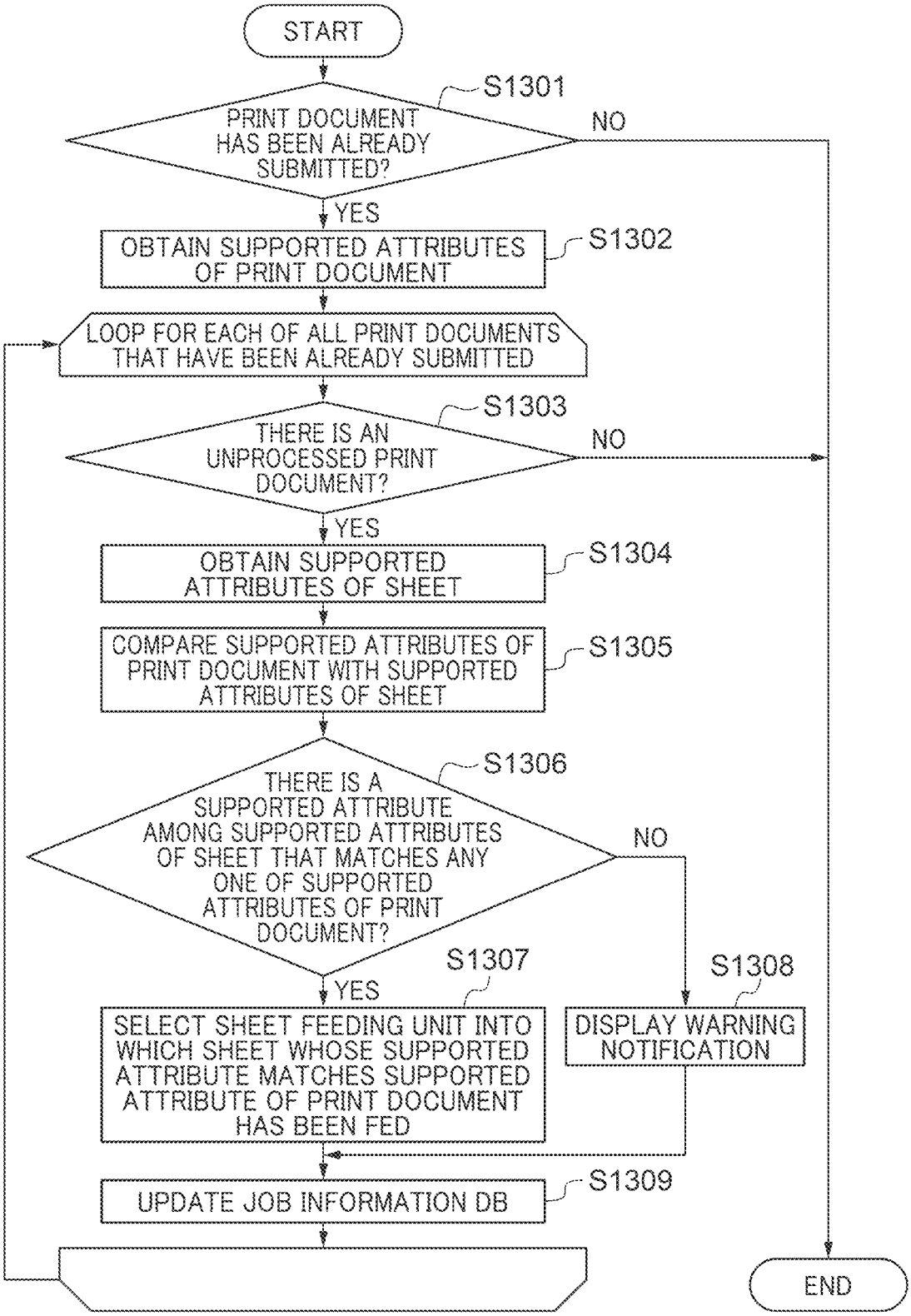
FIG. 13 is a flowchart that shows another procedure of the sheet feeding unit selecting processing executed by the PC shown in FIG. 1.

FIG. 13 is a flowchart that shows another procedure of the sheet feeding unit selecting processing executed by the PC 101 shown in FIG. 1. It should be noted that the sheet feeding unit selecting processing shown in FIG. 13 is similar to the sheet feeding unit selecting processing shown in FIG. 11 described above, and hereinafter, in particular, the contents that are different from the sheet feeding unit selecting processing shown in FIG. 11 described above will be described. Similar to the sheet feeding unit selecting processing shown in FIG. 11 described above, the sheet feeding unit selecting processing shown in FIG. 13 is also realized by the CPU 300 executing a program stored in the ROM 301 or the like. Similar to the sheet feeding unit selecting processing shown in FIG. 11 described above, the sheet feeding unit selecting processing shown in FIG. 13 is also executed at the timing when "automatic roll sheet" has been selected in the sheet feeding method selecting section 606. It should be noted that the PC 101 includes an attribute information DB 1400 shown in FIG. 14A and a sheet information DB 1404 shown in FIG. 14B.

The attribute information DB 1400 is a database that manages information for determining supported attributes based on the characteristics of a print document, and is defined in advance within the program of the print control application. It should be noted that a configuration, in which the PC 101 obtains the attribute information DB 1400 from outside, may be used. The attribute information DB 1400 includes an attribute determination item 1401, a determination parameter 1402, and a supported attribute 1403.

In the attribute determination item 1401, item(s) of the print document that determine the supported attributes are registered. It should be noted that in the present embodiment, the supported attributes may be determined based on one attribute determination item, or the supported attributes may be determined based on a plurality of attribute determination items. In the determination parameter 1402, a parameter corresponding to the attribute determination item is registered. In the supported attribute 1403, attribute(s) corresponding to the determination parameter are registered. For example, in the case that the file type is PDF, the supported attributes are drawing and document. It should be noted that in FIG. 14A, only the file type is shown in the attribute determination item 1401, but the attribute determination item 1401 is not limited to the file type. For example, a rendering command may be registered in the attribute determination item 1401. In this case, for example, a type of the rendering command and/or an area ratio of a region indicated by the rendering command is registered in the determination parameter 1402.

The sheet information DB 1404 is a database that manages information for determining supported attributes based on the sheet category, and is defined in advance within the program of the print control application. It should be noted that a configuration, in which the PC 101 obtains the sheet information DB 1404 from the image forming apparatus 100 or the like, may be used. As shown in FIG. 14B, the sheet information DB 1404 includes a sheet category 1405 and a supported attribute 1406. The sheet category 1405 corresponds to the sheet category 505 of the sheet feeding unit information DB 412 described above. In the supported attribute 1406, attribute(s) corresponding to the sheet category are registered. The PC 101 is able to use the information in the sheet information DB 1404 to identify the attributes corresponding to the sheets that have been fed into the sheet feeding unit 207*a*, the sheet feeding unit 207*b*, the sheet feeding unit 207*c*, and the sheet feeding unit 207*d* of the image forming apparatus 100.

As shown in FIG. 13, first, the CPU 300 determines whether or not the print document has been already submitted to the file list display section 601 (S1301). In the case of being determined in S1301 that the print document has not been submitted to the file list display section 601, the sheet feeding unit selecting processing ends. On the other hand, in the case of being determined in S1301 that the print document has been already submitted to the file list display section 601, the sheet feeding unit selecting processing proceeds to S1302.

In S1302, the CPU 300 obtains supported attributes of the already-submitted print document based on the information in the attribute determination item 1401. For example, in the case that the file type of the print document is "PDF", the CPU 300 obtains "document, drawing" as the supported attributes of this print document. Next, the CPU 300 executes processes of S1303 to S1309 for all the print documents that have been submitted to the file list display section 601.

Similar to S1103 described above, in S1303, the CPU 300 determines whether or not there are unprocessed print documents remaining among the print documents that have been submitted to the file list display section 601. In the case of being determined in S1303 that there are no unprocessed print documents remaining among the print documents that have been submitted to the file list display section 601, the sheet feeding unit selecting processing ends. On the other hand, in the case of being determined in S1303 that there are unprocessed print documents remaining among the print documents that have been submitted to the file list display section 601, the CPU 300 identifies one print document from among the unprocessed print documents. Next, the sheet feeding unit selecting processing proceeds to S1304.

In S1304, the CPU 300 obtains supported attributes of the sheets that have been fed into the physical sheet feeding units corresponding to "automatic roll sheet" that has been selected by the user. Specifically, the CPU 300 obtains information on the sheet categories corresponding to "automatic roll sheet" that has been selected by the user from the sheet feeding unit information DB 412, and obtains supported attributes of the obtained sheet categories from the sheet information DB 1404. More specifically, the CPU 300 obtains "plain paper, tracing paper, glossy paper" from the sheet feeding unit information DB 412, and obtains "document, drawing", "drawing", and "photograph" that correspond to "plain paper", "tracing paper", and "glossy paper", respectively, from the sheet information DB 1404.

Next, in S1305, the CPU 300 compares the supported attributes of the print document obtained in S1302 with the supported attributes of the sheets obtained in S1304. Next, in S1306, the CPU 300 determines whether or not there is a supported attribute among the supported attributes of the sheets obtained in S1304 that matches any one of the supported attributes of the print document obtained in S1302.

For example, in the case that the supported attributes of the print document obtained in S1302 are "document, drawing" and the supported attributes of the sheets obtained in S1304 are "document, drawing", "drawing", and "photograph", "document, drawing" that is the supported attributes of the print document matches "document, drawing" that is the supported attributes of the sheet (plain paper). In such a case, it is determined in S1306 that there is a supported attribute among the supported attributes of the sheets obtained in S1304 that matches any one of the supported attributes of the print document obtained in S1302, and the sheet feeding unit selecting processing proceeds to S1307. In S1307, the CPU 300 selects the sheet feeding unit 207*a*, into which the sheet (plain paper) of the sheet category of the supported attribute that matches the supported attribute of the print document has been fed, as the sheet feeding unit to be used in the printing processing. Next, the sheet feeding unit selecting processing proceeds to S1309, which will be described below.

On the other hand, in the case of being determined in S1306 that there is no supported attribute among the supported attributes of the sheets obtained in S1304 that matches any one of the supported attributes of the print document obtained in S1302, the sheet feeding unit selecting processing proceeds to S1308. In S1308, the CPU 300 displays a warning notification on the print setting screen 600. The warning notification includes, for example, a message prompting to replace the sheet fed into the sheet feeding unit of the image forming apparatus 100.

Next, the CPU 300 updates the job information DB 417 (S1309). Specifically, the CPU 300 records (sets) the information indicating the physical sheet feeding unit, which has been selected in S1307, in the output destination sheet feeding unit 905. Thereafter, the sheet feeding unit selecting processing ends.

In the embodiment described above, the virtual sheet feeding unit is obtained by integrating the plurality of physical sheet feeding units, into which the sheets having the same sheet width but different in the predetermined characteristic have been fed, among the sheet feeding unit 207*a*, the sheet feeding unit 207*b*, the sheet feeding unit 207*c*, and the sheet feeding unit 207*d*. It should be noted that as described above, the predetermined characteristic is the sheet type, the weight of the sheet, or the thickness of the sheet. As a result, the user is able to set the sheet feeding unit, into which the sheet with the sheet type, the weight, or the thickness that is suitable for the print document has been fed, to the sheet feeding unit to be used in the printing processing without selecting a sheet feeding unit, into which the sheet suitable for the print document has been fed, from among the plurality of the sheet feeding unit 207*a*, the sheet feeding unit 207*b*, the sheet feeding unit 207*c*, and the sheet feeding unit 207*d*.

In addition, in the embodiment described above, of the two or more physical sheet feeding units corresponding to the virtual sheet feeding unit, the sheet feeding unit, into which the sheet whose attribute information matches attribute information of the submitted print document has been fed, is set to the sheet feeding unit to be used in the printing processing. As a result, the user is able to set the sheet feeding unit, into which the sheet whose attribute information matches the attribute information of the submitted print document has been fed, to the sheet feeding unit to be used in the printing processing without selecting a sheet feeding unit, into which the sheet suitable for the print document has been fed, from among the plurality of the sheet feeding unit 207*a*, the sheet feeding unit 207*b*, the sheet feeding unit 207*c*, and the sheet feeding unit 207*d*.

It should be noted that in the embodiment described above, the configuration has been described in which control to select an appropriate sheet feeding unit is performed in accordance with that the user has selected "automatic roll sheet" in the sheet feeding method selecting section 606, but the present invention is not limited to this configuration. For example, even in the case that the user does not select "automatic roll sheet" in the sheet feeding method selecting section 606, the control to select an appropriate sheet feeding unit may be performed at a timing when the file list display section 601 has detected the submission or update of the print document.

Figure 15:
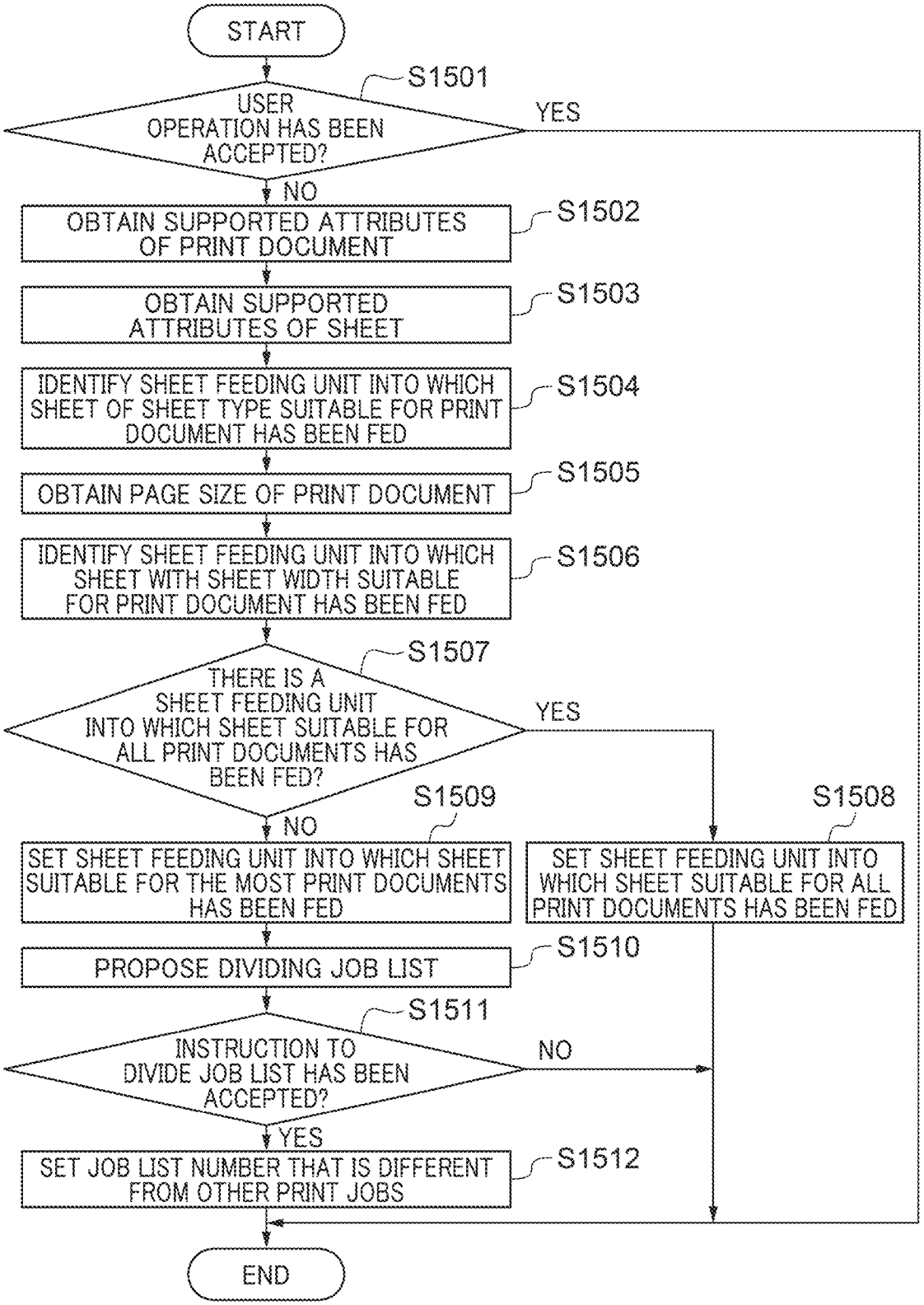
FIG. 15 is a flowchart that shows a procedure of a sheet feeding unit automatic setting processing executed by the PC shown in FIG. 1.

FIG. 15 is a flowchart that shows a procedure of a sheet feeding unit automatic setting processing executed by the PC 101 shown in FIG. 1. The sheet feeding unit automatic setting processing is realized by the CPU 300 executing a program stored in the ROM 301 or the like. The sheet feeding unit automatic setting processing is started at a timing when the file list display section 601 has detected the submission or update of the print document after the sheet feeding unit list creating processing described above has been executed and the sheet feeding unit list of each image forming apparatus has been created. It should be noted that in FIG. 15, as an example, it is assumed that the sheet of 24-inch plain paper A has been fed into the sheet feeding unit 207*a*, the sheet of 36-inch plain paper A has been fed into the sheet feeding unit 207*b*, and the sheet of 24-inch glossy paper has been fed into the sheet feeding unit 207*c*. In other words, the created sheet feeding unit list includes information about the sheet feeding unit 207*a*, the sheet feeding unit 207*b*, and the sheet feeding unit 207*c* as the information about the physical sheet feeding units, and further includes the information about the virtual sheet feeding unit that is obtained by integrating the sheet feeding unit 207*a* and the sheet feeding unit 207*b*, into which the sheets with the same sheet type but different sheet widths have been fed, into one.

As shown in FIG. 15, first, the CPU 300 determines whether or not a user operation has been accepted during a time period from when the print setting screen 600 is displayed until a predetermined time has elapsed (S1501). In the case of being determined in S1501 that a user operation has been accepted during the time period from when the print setting screen 600 is displayed until the predetermined time has elapsed, the CPU 300 determines that the user has performed a print setting operation and that automatic selection of the sheet feeding unit is unnecessary, and ends the sheet feeding unit automatic setting processing.

On the other hand, in the case of being determined in S1501 that a user operation has not been accepted during the time period from when the print setting screen 600 is displayed until the predetermined time has elapsed, the CPU 300 obtains the supported attributes of all the print documents that have been submitted to the file list display section 601 based on the information in the attribute determination item 1401.

Next, the CPU 300 obtains the supported attributes of the sheets corresponding to the physical sheet feeding units and the virtual sheet feeding unit that are included in the created sheet feeding unit list, respectively (S1503). Specifically, the CPU 300 obtains "plain paper" and "glossy paper" from the sheet feeding unit information DB 412, and obtains "document, drawing" and "photograph" corresponding to "plain paper" and "glossy paper", respectively, from the sheet information DB 1404.

Next, the CPU 300 identifies, for each print document, the sheet feeding unit, into which the sheet of the sheet type suitable for the print document has been fed (S1504). It should be noted that the sheet feeding unit, into which the sheet of the sheet type suitable for the print document has been fed, means a sheet feeding unit, into which the sheet with the supported attribute that matches the supported attribute of the print document has been fed. For example, in the case that the print document is "PDF" whose supported attribute is "document, drawing", as the sheet feeding unit, into which the sheet of the sheet type suitable for the print document has been fed, the sheet feeding unit 207*a*, the sheet feeding unit 207*b*, and the virtual sheet feeding unit are identified. In addition, in the case that the print document is "TIFF" whose supported attribute is "photograph", as the sheet feeding unit, into which the sheet of the sheet type suitable for the print document has been fed, the sheet feeding unit 207*c* is identified. It should be noted that in the case that there is a print document whose attribute information does not match the attribute information of all the sheets in S1504, as in S1308 described above, the CPU 300 may display a warning notification and end the sheet feeding unit automatic setting processing.

Next, the CPU 300 obtains the page sizes of all the print documents that have been submitted to the file list display section 601 (S1505). Next, the CPU 300 identifies, for each print document, from among the sheet feeding units that have been identified in S1504, the sheet feeding unit, into which the sheet with the sheet width suitable for the print document has been fed, based on the obtained page sizes (S1506). It should be noted that the sheet with the sheet width suitable for the print document means a sheet with the sheet width that does not cause the image defect and has the smallest margin. For example, the virtual sheet feeding unit holds a plurality of sheet widths, and for each of the plurality of sheet widths, the determination of the presence or absence of the image defect and the calculation of the margin are performed, and any one of the plurality of sheet widths may be an appropriate sheet width. It should be noted that there may be a case where there is not only one but also a plurality of sheet feeding units, into which the sheet with the sheet width suitable for the print document has been fed. For example, in the case that the print document is "PDF" and the sheet width suitable for this print document is 24 inches, as the sheet feeding unit, into which the sheet with the sheet width suitable for this print document has been fed, the sheet feeding unit 207*a* and the virtual sheet feeding unit from among the sheet feeding unit 207*a*, the sheet feeding unit 207*b*, and the virtual sheet feeding unit are identified.

Next, the CPU 300 determines whether or not there is a sheet feeding unit into which the sheet suitable for all the print documents has been fed (S1507). In the case of being determined in S1507 that there is a sheet feeding unit into which the sheet suitable for all the print documents has been fed, the CPU 300 sets this sheet feeding unit (the sheet feeding unit into which the sheet suitable for all the print documents has been fed) in the sheet feeding method selecting section 606 (S1508), and ends the sheet feeding unit automatic setting processing.

On the other hand, in the case of being determined in S1507 that there is no sheet feeding unit into which the sheet suitable for all the print documents has been fed, the CPU 300 sets a sheet feeding unit, into which the sheet suitable for the most print documents has been fed, in the sheet feeding method selecting section 606 (S1509). It should be noted that although the configuration that sets the sheet feeding unit, into which the sheet suitable for the most print documents has been fed, in the sheet feeding method selecting section 606 in S1509 has been described, the present invention is not limited to this configuration. For example, a sheet feeding unit, into which the sheet with the least number of unsuitable print documents has been fed, may be set in the sheet feeding method selecting section 606, or a sheet feeding unit, into which the sheet that will result in the least image defect amount for all the print documents has been fed, may be set in the sheet feeding method selecting section 606.

Next, the CPU 300 proposes to the user to divide a job list (S1510). Specifically, the CPU 300 causes the print setting screen 600 to display a selection user interface (a selection UI) that allows the user to select whether or not to divide print document(s), for which better results can be obtained by selecting a different sheet feeding unit (another sheet feeding unit), into a different job list (another job list). The user is able to use this selection UI to issue an instruction of whether or not to divide the job list. Next, the CPU 300 determines whether or not an instruction to divide the job list has been accepted from the user (S1511).

In S1511, in the case that an instruction not to divide the job list, rather than an instruction to divide the job list, has been accepted from the user, the sheet feeding unit automatic setting processing ends. On the other hand, in S1511, in the case that an instruction to divide the job list has been accepted from the user, the CPU 300 makes the print document(s), for which better results can be obtained by selecting a different sheet feeding unit, independent in the file list display section 601. In addition, the CPU 300 sets a number, which is different from other print jobs, in the job list number 907 corresponding to this print job (S1512), and ends the sheet feeding unit automatic setting processing. It should be noted that in the present embodiment, the method of dividing the job list number 907 has been described as a method of being divided into an optimal sheet feeding unit and the sheet feeding units other than the optimal sheet feeding unit, but the present invention is not limited to this method. For example, another division method such as a division method in which the job list is divided for each suitable sheet feeding unit, or a division method of dividing jobs that will cause the image defect into a different job list may be implemented. In addition, in the case that the job list has been divided, it is also possible to execute the sheet feeding unit automatic setting processing for the job list number 907 stored in S1512 from the beginning, and repeat the sheet feeding unit automatic setting processing until proceeding to YES in S1507. By controlling in this manner, the optimal sheet feeding unit has been selected for each divided job list, making it possible to prevent the occurrence of the image defect.

In the embodiment described above, based on the attribute information of the submitted print document and the attribute information of the sheets, the sheet feeding unit, into which the sheet of the sheet type suitable for the print document has been fed, is identified from among the plurality of sheet feeding units, including the physical sheet feeding units and the virtual sheet feeding unit (S1504). In addition, from among the sheet feeding units that have been identified in S1504 based on the sheet feeding unit information and the size information of the print document, the sheet feeding unit, into which the sheet with the sheet width suitable for the print document has been fed, is identified (S1506). The sheet feeding unit to be used in the printing processing is set from among the sheet feeding units that have been identified in S1506. That is, the user does not need to select a physical sheet feeding unit or a virtual sheet feeding unit in the sheet feeding method selecting section 606. As a result, it is possible to reduce the labor required for the user to set the sheet feeding unit.

In addition, in the embodiment described above, from among the sheet feeding units that have been identified in S1506, the sheet feeding unit, into which the sheet suitable for all the submitted print documents has been fed, is set to the sheet feeding unit to be used in the printing processing. As a result, the user is able to set the sheet feeding unit, into which the sheet suitable for all the submitted print documents has been fed, to the sheet feeding unit to be used in the printing processing without selecting a physical sheet feeding unit or a virtual sheet feeding unit in the sheet feeding method selecting section 606.

In addition, in the embodiment described above, from among the sheet feeding units that have been identified in S1506, the sheet feeding unit, into which the sheet suitable for some of the print documents has been fed, is set to the sheet feeding unit to be used in the printing processing. A print document that is not suitable for the sheet fed into the set sheet feeding unit is divided into another job list different from one job list that performs the printing processing by using the set sheet feeding unit. As a result, in the printing processing of this print document, it is possible to set, the sheet feeding unit, into which the sheet suitable for this print document has been fed.

It should be noted that in the present embodiment, when having been changed to the other image forming apparatus in the printer selecting section 605 on the print setting screen 600, control may be performed so as to take over the sheet feeding unit before the change. For example, in the case that the user has changed to the other image forming apparatus in the printer selecting section 605 in a state where the image forming apparatus 100 has been set in the printer selecting section 605 and one of the sheet feeding units has been selected in the sheet feeding method selecting section 606, the CPU 300 performs a determination of whether or not to be capable of taking over the sheet feeding unit before the change. Specifically, the CPU 300 determines whether or not in sheet feeding unit information of the image forming apparatus after the change that has been registered in the sheet feeding unit information DB 412, there is any information matching the information on the sheet width 503 and the sheet type 504 corresponding to the sheet feeding unit selected in the sheet feeding method selecting section 606 when the image forming apparatus 100 has been set in the printer selecting section 605. In the case that in the sheet feeding unit information of the image forming apparatus after the change that has been registered in the sheet feeding unit information DB 412, there is information matching the information on the sheet width 503 and the sheet type 504 corresponding to the sheet feeding unit selected in the sheet feeding method selecting section 606 when the image forming apparatus 100 has been set in the printer selecting section 605, the CPU 300 takes over (continues to use) the sheet feeding unit before the change, that is, takes over (continues to use) the sheet feeding unit selected in the sheet feeding method selecting section 606 when the image forming apparatus 100 has been set in the printer selecting section 605. As a result, when having been changed to the other image forming apparatus in the printer selecting section 605, it is possible to use the settings of the sheet feeding unit that has been selected for the image forming apparatus before the change as is, and thus it is possible to reduce the labor required for the user to set the sheet feeding unit.

It should be noted that in the present embodiment, the configuration, which controls the presence or absence of taking over the sheet feeding unit before the change based on whether or not there is information that matches the information on the sheet width 503 and the sheet type 504, has been described, but the present invention is not limited to this configuration. For example, the presence or absence of taking over the sheet feeding unit before the change may be controlled based on whether or not there is information that matches the information on the sheet category 505. Alternatively, the presence or absence of taking over the sheet feeding unit before the change may be controlled based on whether or not there is information that substantially matches the information on the additional sheet information 506.

In the present embodiment, the configuration has been described in which the PC 101 executes the sheet feeding unit list creating processing, the sheet feeding unit selecting processing, the sheet feeding unit automatic setting processing, etc., which have been described above, but in the case that the image forming apparatus 100 includes the functions that the PC 101 includes, the image forming apparatus 100 may execute these processings (the sheet feeding unit list creating processing, the sheet feeding unit selecting processing, the sheet feeding unit automatic setting processing, etc., which have been described above). With such a configuration as well, it is possible to achieve the same effects as those of the above-described embodiment.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., ASIC) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2023-119090, filed on Jul. 21, 2023, which is hereby incorporated by reference herein in its entirety.

What is claimed is:

1. A control apparatus that sets a sheet feeding unit to be used in printing processing performed by an image forming apparatus including a plurality of sheet feeding units, the control apparatus comprising:

at least one processor; and a memory coupled to the at least one processor storing instructions that, when executed by the at least one processor, cause the at least one processor to function as:

an obtaining unit that obtains information about sheets, which have been fed into the plurality of sheet feeding units, respectively; and a display control unit that displays a setting screen for allowing a user to select the sheet feeding unit to be used in the printing processing from among the plurality of sheet feeding units based on the obtained information about the sheets, wherein information about a virtual sheet feeding unit, which is obtained by integrating two or more sheet feeding units, into which sheets satisfying a predetermined condition have been fed, among the plurality of sheet feeding units into one, is displayed on the setting screen, and in a case that the information about the virtual sheet feeding unit has been selected by the user, one sheet feeding unit of the two or more sheet feeding units is set as the sheet feeding unit to be used in the printing processing.

2. The control apparatus according to claim 1, wherein sheets with different sheet widths but the same predetermined characteristic other than the sheet width have been fed into the two or more sheet feeding units, respectively.

3. The control apparatus according to claim 2, wherein a sheet feeding unit of the two or more sheet feeding units, into which a sheet that does not cause an image defect and has the smallest margin area has been fed, is set as the sheet feeding unit to be used in the printing processing.

4. The control apparatus according to claim 3, wherein based on data obtained by performing a rotating processing on a submitted print document, a determination of presence or absence of the image defect and a calculation of the margin area are performed.

5. The control apparatus according to claim 2, wherein the predetermined characteristic is a sheet type.

6. The control apparatus according to claim 2, wherein the predetermined characteristic is a weight.

7. The control apparatus according to claim 2, wherein the predetermined characteristic is a thickness.

8. The control apparatus according to claim 1, wherein sheets, which have the same sheet width but are different in a predetermined characteristic other than the sheet width, have been fed into the two or more sheet feeding units, respectively.

9. The control apparatus according to claim 8, wherein a sheet feeding unit of the two or more sheet feeding units, into which a sheet whose attribute information matches attribute information of a submitted print document has been fed, is set as the sheet feeding unit to be used in the printing processing.

10. The control apparatus according to claim 1, wherein an apparatus that causes to execute the printing processing is set on the setting screen, and the at least one processor is caused to further function as:

a control unit that, in a case that the apparatus that causes to execute the printing processing has been changed to another image forming apparatus in a state where one image forming apparatus has been set to the apparatus that causes to execute the printing processing and the sheet feeding unit to be used in the printing processing has been set on the setting screen, controls whether or not to take over settings of the sheet feeding unit to be used in the printing processing based on information about sheets corresponding to the one image forming apparatus and information about sheets corresponding to the other image forming apparatus.

11. The control apparatus according to claim 1, wherein on the setting screen, together with the virtual sheet feeding unit, the two or more sheet feeding units are displayed, respectively.

12. The control apparatus according to claim 1, wherein the at least one processor is caused to further function as a transmitting unit that transmits, to the image forming apparatus, a print job for causing the image forming apparatus to execute the printing processing that includes information about the set sheet feeding unit, and the control apparatus is an information processing apparatus separate from the image forming apparatus.

13. The control apparatus according to claim 1, wherein the image forming apparatus comprises the control apparatus.

14. A control apparatus that sets a sheet feeding unit to be used in printing processing performed by an image forming apparatus including a plurality of sheet feeding units, the control apparatus comprising:

at least one processor; and a memory coupled to the at least one processor storing instructions that, when executed by the at least one processor, cause the at least one processor to function as:

an obtaining unit that obtains information about sheets, which have been fed into the plurality of sheet feeding units, respectively;

a first identifying unit that, based on the obtained information about the sheets and attribute information of a print document submitted, identifies sheet feeding units, into which sheets of sheet types suitable for the print document have been fed, from among the plurality of sheet feeding units;

a second identifying unit that, based on the obtained information about the sheets and size information of the print document, identifies sheet feeding units, into which sheets with sheet sizes suitable for the print document have been fed, from among the sheet feeding units identified by the first identifying unit; and a setting unit that sets the sheet feeding unit to be used in the printing processing from among the sheet feeding units identified by the second identifying unit.

15. The control apparatus according to claim 14, wherein a plurality of print documents are submitted, and the setting unit sets a sheet feeding unit, into which a sheet suitable for all the submitted print documents has been fed, among the sheet feeding units identified by the second identifying unit as the sheet feeding unit to be used in the printing processing.

16. The control apparatus according to claim 14, wherein the at least one processor is caused to further function as a managing unit that, when a plurality of print documents are submitted, manages print documents to be printed by a job list, the setting unit sets a sheet feeding unit, into which a sheet suitable for some of the print documents has been fed, among the sheet feeding units identified by the second identifying unit as the sheet feeding unit to be used in the printing processing, and the managing unit divides a print document that is not suitable for the sheet fed into the set sheet feeding unit into another job list different from one job list that performs the printing processing by using the set sheet feeding unit.

17. The control apparatus according to claim 14, wherein the at least one processor is caused to further function as a transmitting unit that transmits, to the image forming apparatus, a print job for causing the image forming apparatus to execute the printing processing that includes information about the set sheet feeding unit, and the control apparatus is an information processing apparatus separate from the image forming apparatus.

18. The control apparatus according to claim 14, wherein the image forming apparatus comprises the control apparatus.

19. A control method for a control apparatus that sets a sheet feeding unit to be used in printing processing performed by an image forming apparatus including a plurality of sheet feeding units, the control method comprising:

a step of obtaining information about sheets, which have been fed into the plurality of sheet feeding units, respectively; and a step of displaying a setting screen for allowing a user to select the sheet feeding unit to be used in the printing processing from among the plurality of sheet feeding units based on the obtained information about the sheets, wherein information about a virtual sheet feeding unit, which is obtained by integrating two or more sheet feeding units, into which sheets satisfying a predetermined condition have been fed, among the plurality of sheet feeding units into one, is displayed on the setting screen, and in a case that the information about the virtual sheet feeding unit has been selected by the user, one sheet feeding unit of the two or more sheet feeding units is set as the sheet feeding unit to be used in the printing processing.

20. A control method for a control apparatus that sets a sheet feeding unit to be used in printing processing performed by an image forming apparatus including a plurality of sheet feeding units, the control method comprising:

a step of obtaining information about sheets, which have been fed into the plurality of sheet feeding units, respectively;

a first identifying step of, based on the obtained information about the sheets and attribute information of a print document submitted, identifying sheet feeding units, into which sheets of sheet types suitable for the print document have been fed, from among the plurality of sheet feeding units;

a second identifying step of, based on the obtained information about the sheets and size information of the print document, identifying sheet feeding units, into which sheets with sheet sizes suitable for the print document have been fed, from among the sheet feeding units identified in the first identifying step; and a step of setting the sheet feeding unit to be used in the printing processing from among the sheet feeding units identified in the second identifying step.

21. A non-transitory computer-readable storage medium storing a program for causing a computer to execute a control method for a control apparatus that sets a sheet feeding unit to be used in printing processing performed by an image forming apparatus including a plurality of sheet feeding units, the control method comprising:

a step of obtaining information about sheets, which have been fed into the plurality of sheet feeding units, respectively; and a step of displaying a setting screen for allowing a user to select the sheet feeding unit to be used in the printing processing from among the plurality of sheet feeding units based on the obtained information about the sheets, wherein information about a virtual sheet feeding unit, which is obtained by integrating two or more sheet feeding units, into which sheets satisfying a predetermined condition have been fed, among the plurality of sheet feeding units into one, is displayed on the setting screen, and in a case that the information about the virtual sheet feeding unit has been selected by the user, one sheet feeding unit of the two or more sheet feeding units is set as the sheet feeding unit to be used in the printing processing.

22. A non-transitory computer-readable storage medium storing a program for causing a computer to execute a control method for a control apparatus that sets a sheet feeding unit to be used in printing processing performed by an image forming apparatus including a plurality of sheet feeding units, the control method comprising:

a step of obtaining information about sheets, which have been fed into the plurality of sheet feeding units, respectively;

a first identifying step of, based on the obtained information about the sheets and attribute information of a print document submitted, identifying sheet feeding units, into which sheets of sheet types suitable for the print document have been fed, from among the plurality of sheet feeding units;

a second identifying step of, based on the obtained information about the sheets and size information of the print document, identifying sheet feeding units, into which sheets with sheet sizes suitable for the print document have been fed, from among the sheet feeding units identified in the first identifying step; and a step of setting the sheet feeding unit to be used in the printing processing from among the sheet feeding units identified in the second identifying step.

* * * * *